US011089921B2

(12) United States Patent
Jack et al.

(10) Patent No.: US 11,089,921 B2
(45) Date of Patent: Aug. 17, 2021

(54) MODULAR DISPENSER SYSTEM

(71) Applicant: Turtle Wax, Inc., Addison, IL (US)

(72) Inventors: Robert C. Jack, Arlington Heights, IL (US); Daren Herbert, Naperville, IL (US)

( * ) Notice: Subject to any disclaimer, the term of this patent is extended or adjusted under 35 U.S.C. 154(b) by 0 days.

(21) Appl. No.: 16/381,908

(22) Filed: Apr. 11, 2019

(65) Prior Publication Data

US 2019/0313862 A1 Oct. 17, 2019

Related U.S. Application Data

(60) Provisional application No. 62/658,971, filed on Apr. 17, 2018.

(51) Int. Cl.
*A47K 10/38* (2006.01)
*A47K 10/32* (2006.01)

(52) U.S. Cl.
CPC .... *A47K 10/3836* (2013.01); *A47K 2010/328* (2013.01)

(58) Field of Classification Search
CPC ..... A47K 10/421; A47K 10/3836; A47K 2010/328; B65D 21/029
See application file for complete search history.

(56) References Cited

U.S. PATENT DOCUMENTS 2,227,710 A 1/1941 Finn
D189,632 S 1/1961 Mita et al.
D313,176 S 12/1990 Okuda et al.
D324,173 S 2/1992 Lynd
D415,959 S * 11/1999 Antoine ..... D9/724
6,021,924 A * 2/2000 Suck ..... B05B 11/3023 222/105
D422,906 S 4/2000 Mellish
6,170,651 B1 1/2001 Taormina
6,269,970 B1 8/2001 Huang et al.
(Continued)

FOREIGN PATENT DOCUMENTS

EP 005800042-0001 10/2018
EP 005800042-0002 10/2018
(Continued)

OTHER PUBLICATIONS

The United States Patent and Trademark Office, International Search Report and Written Opinion in International Application No. PCT/US19/27060 (dated Jul. 1, 2019) (17 pages).
(Continued)

*Primary Examiner* — Gene O Crawford
*Assistant Examiner* — Kelvin L Randall, Jr.
(74) *Attorney, Agent, or Firm* — Neal, Gerber & Eisenberg LLP; Thomas E. Williams

(57) ABSTRACT

A modular dispenser system is described that can enable users to carry and use items and liquids that can be used together in a convenient, cost effective, and portable manner. The system includes a body, a bottle that is removably secured to the body, and a cover removably engaged to the body. When the body, bottle, and cover are secured together, it may form a unitary object. In this way, a user can easily carry and store the system and its items and liquids simultaneously. The modular dispenser system provides versatility to a user by enabling the user to use the items and the liquids together or separately.

12 Claims, 44 Drawing Sheets

(56) References Cited

U.S. PATENT DOCUMENTS

| | | | | |
|---|---|---|---|---|
| 6,321,937 | B1 * | 11/2001 | DeSimone | A47K 10/3818 221/45 |
| 6,364,101 | B1 | 4/2002 | Schultz | |
| 6,394,987 | B1 * | 5/2002 | Sandlin | A61L 2/18 206/362 |
| 6,401,968 | B1 | 6/2002 | Huang et al. | |
| 6,405,675 | B1 | 6/2002 | Mills | |
| 6,431,405 | B2 * | 8/2002 | Irwin | A47K 10/32 222/192 |
| 6,528,766 | B1 * | 3/2003 | Parks | A47J 36/2433 126/261 |
| 6,883,989 | B2 | 4/2005 | Kushner et al. | |
| 7,055,686 | B2 | 6/2006 | De-Vries | |
| D539,480 | S | 3/2007 | Kostow | |
| RE39,718 | E | 7/2007 | Mayne | |
| 7,497,351 | B2 | 3/2009 | Amundson et al. | |
| D603,721 | S | 11/2009 | Masucci | |
| 7,743,947 | B2 * | 6/2010 | Flasch | A47L 13/26 222/192 |
| 7,922,036 | B2 | 4/2011 | Bendor et al. | |
| D642,060 | S | 7/2011 | Leclair et al. | |
| D643,694 | S | 8/2011 | Lu | |
| 8,006,864 | B2 | 8/2011 | Fryan et al. | |
| 8,113,373 | B2 | 2/2012 | Lin | |
| 8,146,606 | B2 | 4/2012 | Schatteman et al. | |
| 8,371,479 | B2 | 2/2013 | Luft | |
| D689,375 | S | 9/2013 | Garner | |
| D709,387 | S | 7/2014 | Marina et al. | |
| D710,703 | S | 8/2014 | Marina et al. | |
| 8,853,143 | B2 | 10/2014 | Fellows | |
| D726,007 | S | 4/2015 | Beth-Jacob | |
| D727,171 | S | 4/2015 | Marina et al. | |
| D728,382 | S | 5/2015 | Goswell | |
| 9,061,795 | B2 | 6/2015 | Girardot et al. | |
| D742,699 | S | 11/2015 | Boroski | |
| 9,220,379 | B2 | 12/2015 | Winestock et al. | |
| 9,277,843 | B2 | 3/2016 | Mays et al. | |
| 9,278,781 | B1 | 3/2016 | Boldis | |
| 9,327,890 | B1 | 5/2016 | Connelly | |
| 9,358,568 | B2 | 6/2016 | Tabata et al. | |
| 9,439,551 | B1 | 9/2016 | Atkinson et al. | |
| D768,507 | S | 10/2016 | Hotell | |
| 9,526,384 | B2 | 12/2016 | Laflin | |
| 9,630,765 | B1 | 4/2017 | Nelson | |
| 9,643,199 | B2 | 5/2017 | Petkus et al. | |
| 9,731,862 | B2 | 8/2017 | Mays et al. | |
| 9,789,502 | B2 * | 10/2017 | Maddy | B05B 11/3059 |
| D810,581 | S | 2/2018 | Shalev et al. | |
| 9,975,660 | B2 * | 5/2018 | Cartledge | A61L 2/0088 |
| D840,246 | S | 2/2019 | Shalev et al. | |
| D846,408 | S | 4/2019 | Rossetti | |
| 10,279,977 | B2 * | 5/2019 | Fleischman | B65D 21/0228 |
| D856,798 | S | 8/2019 | Giraud et al. | |
| D856,814 | S | 8/2019 | Villarreal et al. | |
| 10,427,825 | B2 * | 10/2019 | Buehrle | B65D 43/0202 |
| 10,549,898 | B2 | 2/2020 | Park | |
| 2002/0179625 | A1 | 12/2002 | Huang et al. | |
| 2003/0080018 | A1 | 5/2003 | Nally | |
| 2005/0035134 | A1 | 2/2005 | Gamoff et al. | |
| 2005/0279757 | A1 | 12/2005 | Bitowft et al. | |
| 2006/0027468 | A1 | 2/2006 | Berar | |
| 2009/0152290 | A1 | 6/2009 | Wang et al. | |
| 2009/0255958 | A1 * | 10/2009 | Santoni | B05B 11/0008 222/321.1 |
| 2009/0289078 | A1 | 11/2009 | Melin et al. | |
| 2009/0314794 | A1 | 12/2009 | Zylka et al. | |
| 2010/0308072 | A1 | 12/2010 | Hood et al. | |
| 2011/0062178 | A1 | 3/2011 | Godsell | |
| 2011/0204048 | A1 | 8/2011 | Carino et al. | |
| 2012/0193316 | A1 | 8/2012 | Starks | |
| 2014/0091086 | A1 | 4/2014 | Sorensen et al. | |
| 2014/0238949 | A1 | 8/2014 | Patel | |
| 2014/0346062 | A1 | 11/2014 | Bukhari et al. | |
| 2016/0046421 | A1 | 2/2016 | Brown et al. | |
| 2017/0050200 | A1 * | 2/2017 | Thompson | B05B 11/0086 |
| 2017/0057691 | A1 | 3/2017 | Clark | |
| 2018/0370684 | A1 | 12/2018 | Brodwick | |
| 2019/0062033 | A1 | 2/2019 | Fleischman et al. | |

FOREIGN PATENT DOCUMENTS

| | | |
|---|---|---|
| EP | 005800042-0003 | 10/2018 |
| GB | 6046531 | 10/2018 |
| GB | 6046532 | 10/2018 |
| GB | 6046533 | 10/2018 |

OTHER PUBLICATIONS

The Whisky Exchange. Retrieved from the Internet on Apr. 17, 2018, but believed accessible on the Internet at least as early as Apr. 16, 2018. "Benedictine Liqueur—2 Part Bottle—Bot. 1950s: The Whisky Exchange" https://www.thewhiskyexchange.com/p/7072/benedictine-liquer-2-part-bottle-bot1950s (3 pages).

Green Design. Retrieved from the Internet on Apr. 17, 2018, but believed accessible on the Internet at least as early as Apr. 16, 2018. "Lego style stacking | Green Design" https://greendesignandystevenson.wordpress.com/2013/12/04/lego-style-stacking/ (5 pages).

World of Bottles. Retrieved from the Internet on Apr. 17, 2018, but believed accessible on the Internet at least as early as Apr. 16, 2018. "200ml stacking bottle set 'Cocolores'—world-of-bottles.co.uk" https://www.world-of-bottles.co.uk/Glass-bottles/Glass-bottles/200ml-glass-bottles/200ml-stacking-bottle-set-Cocolores.html (1 page).

BlenderBottle. Retrieved from the Internet on Apr. 17, 2018, but believed accessible on the Internet at least as early as Apr. 16, 2018. "Stackable Jars for Healthy Portable Snacks—GoStak® | BlenderBottle®" https://www.blenderbottle.com/products/gostak (6 pages.).

Frugal coupon living. Retrieved from the Internet on Apr. 17, 2018, but believed accessible on the Internet at least as early as Apr. 16, 2018. "Stackable Bottles on the Go for $7.99 from $15.99" https://www.frugalcouponliving.com/stackable-bottles-go-7-99-15-99/ (3 pages).

Mexicouponers. Retrieved from the Internet on Apr. 17, 2018, but believed accessible on the Internet at least as early as Apr. 16, 2018. "Clorox Scentiva Disinfecting Wipes & Cleaning Spray As Low As $1.34 ~ PRINT NOW! | Mexicouponers" http://mexicouponers.com/clorox-scentiva-disinfecting-wipes-cleaning-spray-low-1-34-print-now/ (4 pages).

Big Wipes. Retrieved from the Internet on Apr. 17, 2018, but believed accessible on the Internet at least as early as Apr. 16, 2018. "Product range—Big Wipes" https://bigwipes.com/product-range/ (1 page).

Amazon. Retrieved from the Internet on Apr. 17, 2018, but believed accessible on the Internet at least as early as Apr. 16, 2018. "Amazon.com: GreatShield LCD Touch Screen Cleaning Kit with Microfiber Cloth, Brush, Cleaner Wipes Spray Solution for Laptops, PC monitors, . . ." https://www.amazon.com/GreatShield-Cleaning-Microfiber-Smartphones-Camcorders/dp/B00BJNYG1G (10 pages).

Pro Tattoo and Medical Supply. Retrieved from the Internet on Apr. 17, 2018, but believed accessible on the Internet at least as early as Apr. 16, 2018. "Shop Surface Disinfectants, Pro Tattoo and Medical Supply" http://protattooandmedicalsupply.com/index.php?cPath=218 (5 pages).

Clearwax. Retrieved from the Internet on Apr. 17, 2018, but believed accessible on the Internet at least as early as Apr. 16, 2018. "Tristel Dry Wipes (Low Lint)—CLEARWAX" https://www.clearwax.co.uk/product/tristel-dry-wipes/ (2 pages).

New Pig. Retrieved from the Internet on Apr. 17, 2018, but believed accessible on the Internet at least as early as Apr. 16, 2018. "Pig® PR40 All-Purpose Wipers—WIP231—New Pig" https://www.Newpig.com/pig-pr40-all-purpose-wipers/p/WIP231 (3 pages).

Just Hygiene. Retrieved from the Internet on Apr. 17, 2018, but believed accessible on the Internet at least as early as Apr. 16, 2018. "Clinell Universal Wipes" https://www.justhygiene.co.uk/Surface-Cleaning/Multipurpose-Wipes/Clinell-Universal-Wipes (2 pages).

(56) References Cited

OTHER PUBLICATIONS

Walmart. Retrieved from the Internet on Apr. 17, 2018, but believed accessible on the Internet at least as early as Apr. 16, 2018. "Turtle Wax Multi-Purpose Cleaning Wipes, 20 Pack—Walmart.com" https://www.walmart.com/ip/Turtle-Wax-Multi-Purpose-Cleaning-Wipes-20-Pack/16888969 (5 pages).
Aqua Tissue. Retrieved from the Internet on Mar. 9, 2012. "Aqua Tissue Cap" www.aquatissue.com (3 pages).

* cited by examiner

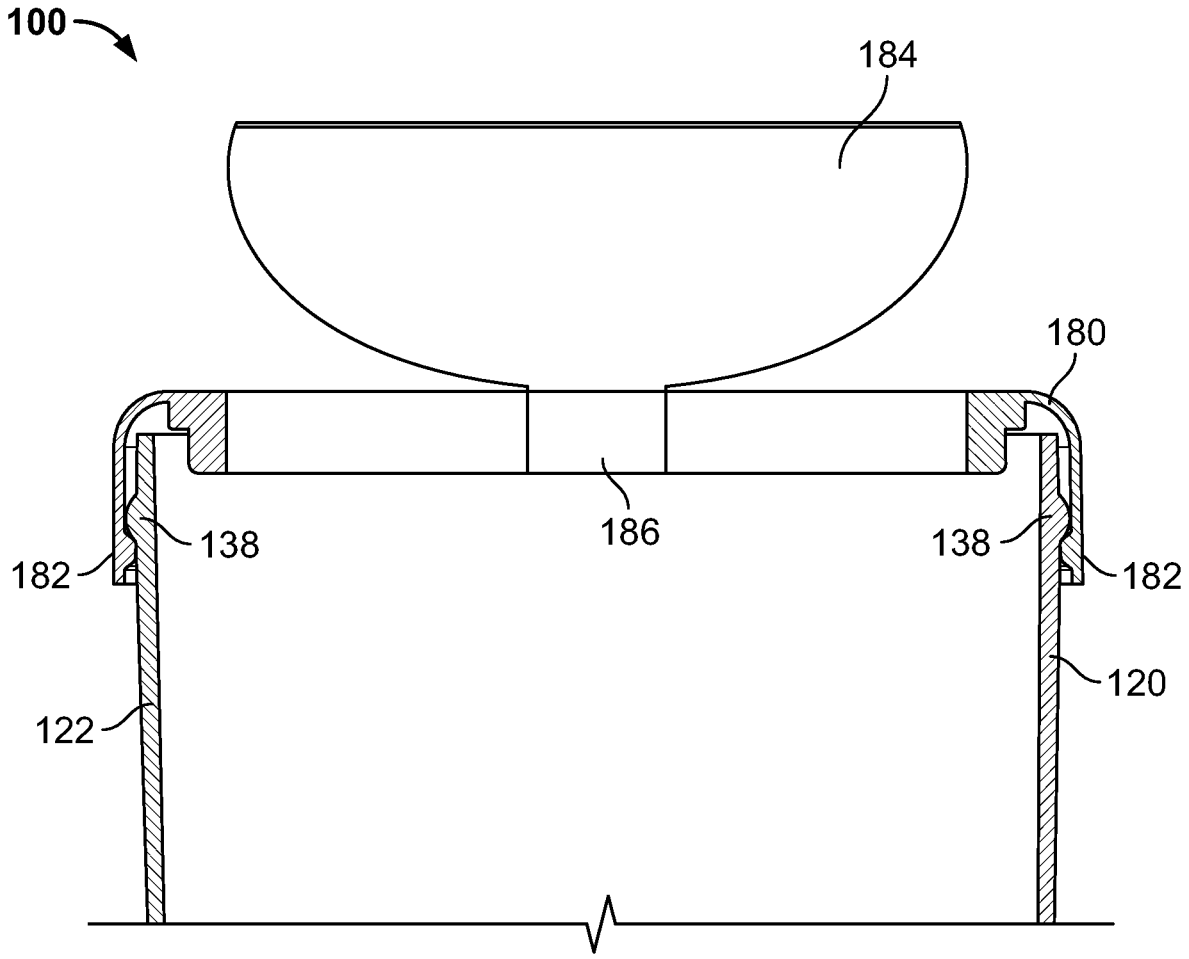
FIG. 1N2

MODULAR DISPENSER SYSTEM

CROSS REFERENCE TO RELATED APPLICATIONS

This application claims the benefit of U.S. Provisional Patent Application No. 62/658,971, filed on Apr. 17, 2018, which is hereby incorporated by reference in its entirety.

TECHNICAL FIELD

This application generally relates to a modular dispenser system for storage and dispensing of items and liquids that can be used together. In particular, this application relates to a modular dispenser system having a body for holding items and a bottle for holding liquids that may be removably securable together, and which enables users to carry and use such items and liquids in a convenient, cost effective, and portable manner.

BACKGROUND

Existing products for items and liquids that are designed for use together typically include a first container for the items and a separate, non-attachable second container for the liquid. However, it can be costly and inconvenient for users to buy and carry such separate containers due to their dissimilar sizes and shapes. By contrast, "wet wipes" for household cleaning purposes are packaged in a single container that commingles the disposable towel or wipe with cleaning liquid to pre-moisten the towel or wipe for instant use when drawn out of the container. Known wet wipes are typically sold as inexpensive, nondurable, disposable towelettes that are saturated in a liquid, such as liquid for cleaning, shining, or protecting a surface. However, the wet wipes are often over-saturated with liquid for many intended uses when initially purchased, and often dry out prematurely when stored and therefore cannot be used for their intended purpose. In addition, wet wipes may not be able to be moistened with or immersed in certain types of liquids or solutions due to adverse interaction with the towelette or wipe material. Moreover, in some situations, a user may wish to use a dry towelette or wipe while maintaining the option for being able to conveniently moisten a disposable towelette or wipe or use the cleaning liquid independently of the towelette or wipe. In other situations, a user may wish to use different types of towels, towelettes, or wipes to suit different needs, with or without a liquid.

Accordingly, there is an opportunity for a system that addresses these concerns. More particularly, there is an opportunity for a modular dispenser system that enables users to carry and use items and liquids that can be used together or independently on-demand in a convenient, cost effective, and portable manner.

SUMMARY

In an embodiment, a modular dispenser system may include a generally cylindrical body, and a bottle removably securable to the body. The body may include a platform comprising a hole formed therein; a sidewall extending upwardly from the platform; a skirt extending downwardly from the platform and forming a recessed area, the skirt adapted to fit over a top portion of a bottle; and a generally circular opening formed at the top of the sidewall. The bottle may include a generally cylindrical top portion having a first diameter, the top portion comprising a mouth; a generally cylindrical bottom portion extending from the top portion and having a second diameter greater than the first diameter; and a sprayer removably attachable to the mouth of the top portion, wherein at least a part of the sprayer is adapted to be accepted by the hole of the platform of the body.

The modular dispenser system may further include a cover removably engageable with the opening of the body. The body may include a first protrusion disposed circumferentially on an outer surface of the sidewall about the opening, and the cover may include a second protrusion disposed circumferentially on an inner surface of the cover and adapted to be removably engageable with the first protrusion of the body. The cover may include an openable lid having a flexible living hinge attached to the cover. The cover may include a dispensing feature having an aperture to hold an item.

The body may include one or more mating protrusions disposed circumferentially on an inner surface of the skirt within the recessed area, and the bottle may include a circumferential groove connecting the top portion and the bottom portion, wherein the groove is adapted to engage with the one or more mating protrusions of the body. The platform of the body may include one or more openings formed about the spindle, the one or more openings generally aligned with the one or more mating protrusions. The bottle may include a spray cap that cover the sprayer. The modular dispenser system may further include a roll of dry wipes contained within the body and fitted over the spindle, and a liquid formulation contained within the bottle. The spindle may maintain a position of the roll of dry wipes within the body.

In another embodiment, a modular dispenser system may include a generally cylindrical body, a bottle removably securable to the body, a cover removably engageable with the opening of the body, a roll of dry wipes contained within the body and fitted over the sprayer, and a liquid formulation contained within the bottle. The body may include a platform that includes a hole formed therein, and one or more openings formed about the hole that are generally aligned with one or more mating protrusions. The body may also include a sidewall extending upwardly from the platform; a skirt extending downwardly from the platform and forming a recessed area, the skirt adapted to fit over a top portion of a bottle; a generally circular opening formed at the top of the sidewall; and the one or more mating protrusions disposed circumferentially on an inner surface of the skirt within the recessed area.

The bottle may include a generally cylindrical top portion having a first diameter, the top portion comprising a mouth; a generally cylindrical bottom portion extending from the top portion and having a second diameter greater than the first diameter; a circumferential groove connecting the top portion and the bottom portion, wherein the groove is adapted to engage with the one or more mating protrusions of the body; and a sprayer removably attachable to the mouth of the top portion, wherein at least a part of the sprayer is adapted to be accepted by the hole of the platform of the body, and wherein the sprayer is further adapted to be used as a spindle when the body and the bottle are secured together. The cover may include an openable lid having a flexible living hinge attached to the cover; and a dispensing feature having an aperture to hold a dry wipe.

In a further embodiment, a modular dispenser system may include a generally cylindrical body, and a bottle removably securable to the body. The body may include a platform comprising a spindle disposed thereupon; a sidewall extending upwardly from the platform; a skirt extending downwardly from the platform and forming a recessed area, the skirt adapted to fit over a top portion of a bottle; and a generally circular opening formed at the top of the sidewall. The bottle may include a generally cylindrical top portion having a first diameter, the top portion comprising a mouth; a generally cylindrical bottom portion extending from the top portion and having a second diameter greater than the first diameter; and a sprayer removably attachable to the mouth of the top portion, wherein at least a part of the sprayer is adapted to be inserted within the spindle of the platform of the body.

The modular dispenser system may further include a cover removably engageable with the opening of the body. The body may include a first protrusion disposed circumferentially on an outer surface of the sidewall about the opening, and the cover may include a second protrusion disposed circumferentially on an inner surface of the cover and adapted to be removably engageable with the first protrusion of the body. The cover may include an openable lid having a flexible living hinge attached to the cover. The cover may include a dispensing feature having an aperture to hold an item.

The body may include one or more mating protrusions disposed circumferentially on an inner surface of the skirt within the recessed area, and the bottle may include a circumferential groove connecting the top portion and the bottom portion, wherein the groove is adapted to engage with the one or more mating protrusions of the body. The platform of the body may include one or more openings formed about the spindle, the one or more openings generally aligned with the one or more mating protrusions. The bottle may include a spray cap that cover the sprayer. The modular dispenser system may further include a roll of dry wipes contained within the body and fitted over the spindle, and a liquid formulation contained within the bottle. The spindle may maintain a position of the roll of dry wipes within the body.

In another embodiment, a modular dispenser system is disclosed, comprising: (a) a generally cylindrical body comprising a first end and a second end, the body further comprising (i) a platform canter-leverly extending radially inwardly from an inner surface of the body, the platform including one or more walls defining a hole therein that is coaxial with the cylindrical body, the platform positioned longitudinally along the body between the first end and the second end, (ii) a sidewall extending upwardly from the platform toward the first end, the sidewall including a circumferential nub positioned proximate the first end and extending outwardly from an outer surface of the body to receive and removably capture a dispenser closure, (iii) a skirt extending downwardly from the platform toward the second end and forming a recessed area, (iv) a pair of opposed, partial-circumferential protrusions positioned at the second end and extending radially inwardly from an inner surface of the skirt, and (v) a generally circular opening formed at the first end and at the second end; and (b) a bottle removably securable to the body, the bottle comprising (i) a generally cylindrical top portion having a first diameter and a circumferential groove for engaging with the opposed, partial-circumferential protrusions for removably securing the bottle to the body, the top portion comprising a mouth, (ii) a generally cylindrical bottom portion extending from the top portion and having a second diameter greater than the first diameter, and (iii) a sprayer removably attachable to the mouth of the top portion, wherein at least a part of the sprayer is adapted to be accepted by the hole of the platform of the body.

These and other embodiments, and various permutations and aspects, will become apparent and be more fully understood from the following detailed description and accompanying drawings, which set forth illustrative embodiments that are indicative of the various ways in which the principles of the disclosure may be employed.

DETAILED DESCRIPTION

Figure 1A:
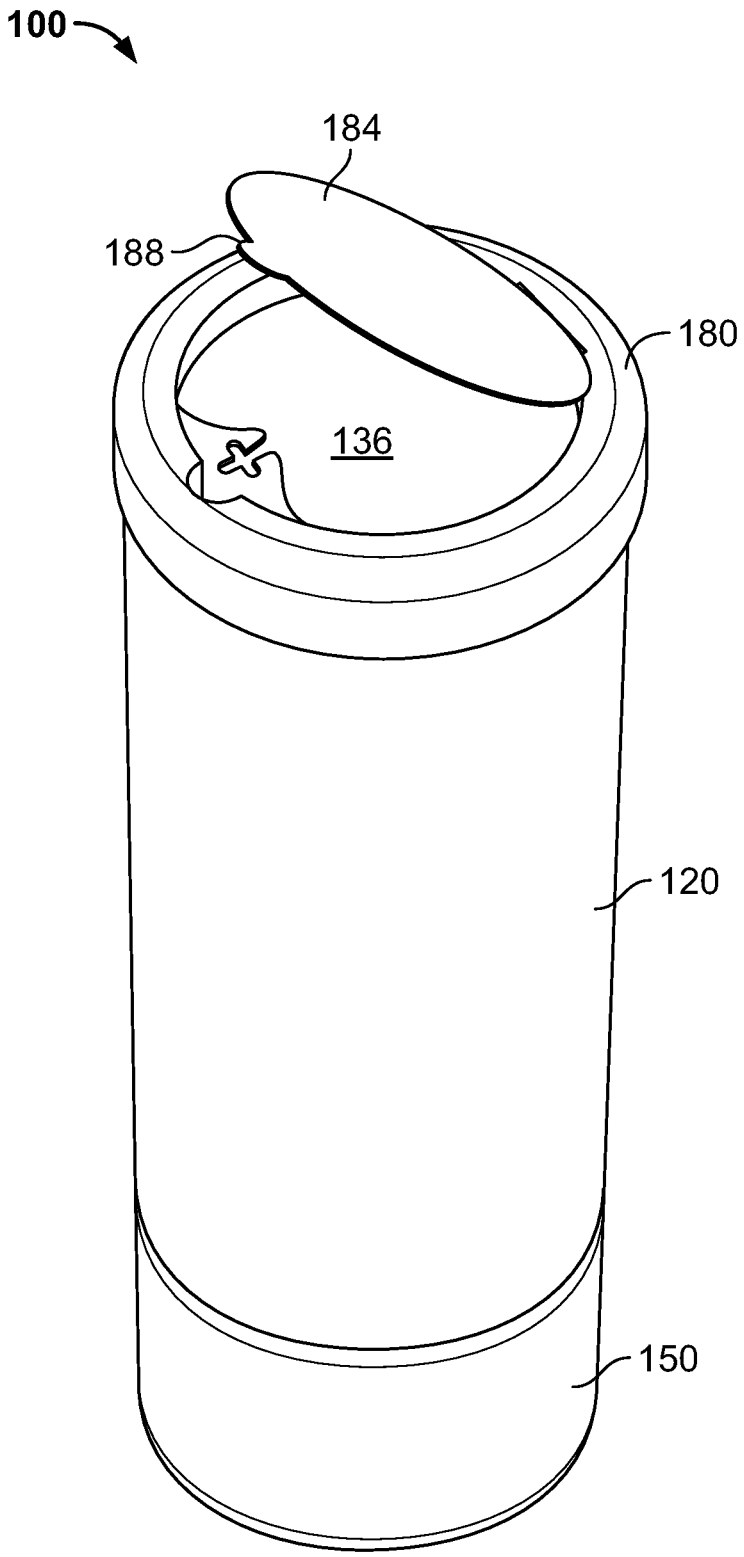
FIGS. 1A-1R are views of embodiments of a modular dispenser system of the instant disclosure including a body, a bottle, and a cover.
Figure 1B:
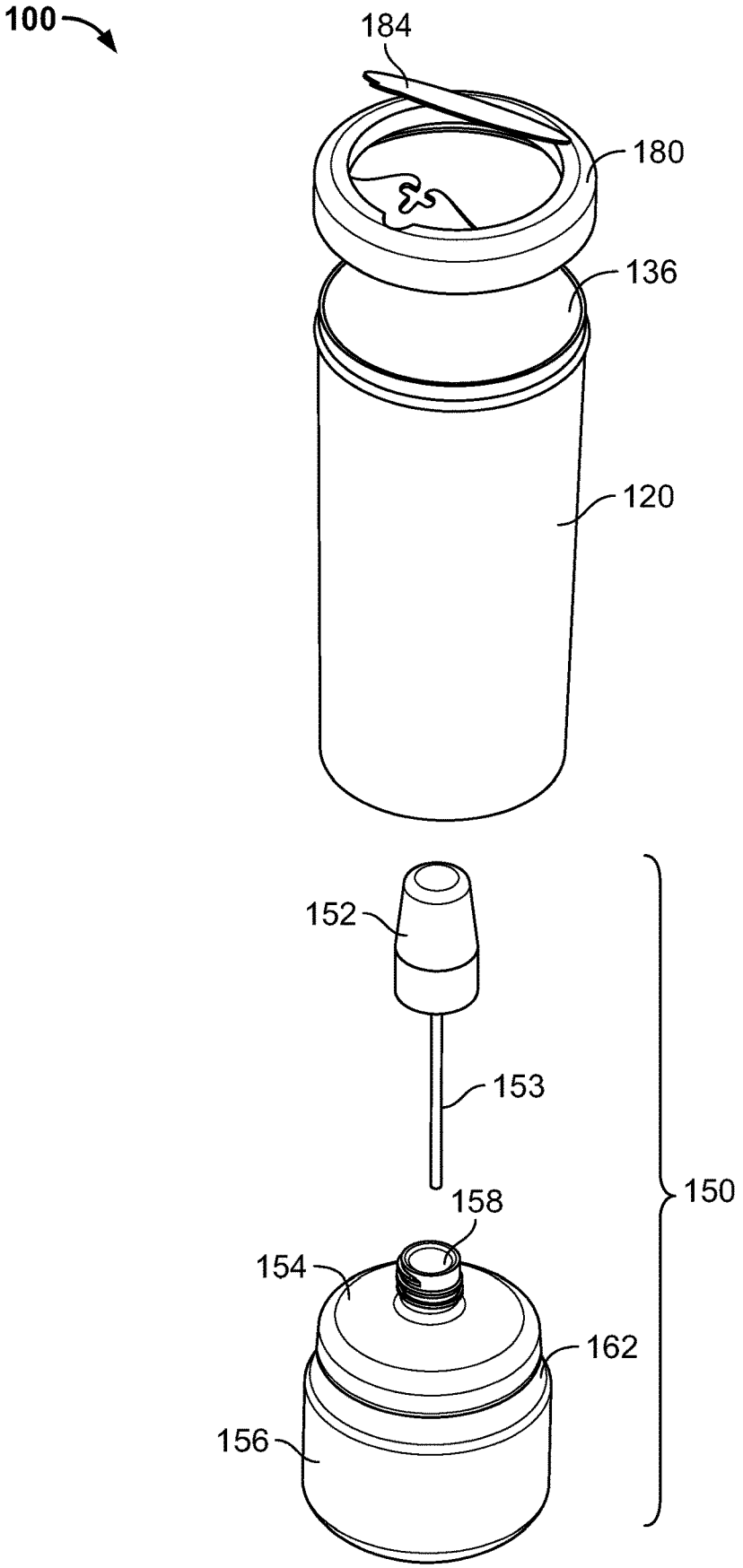
Figure 1C:
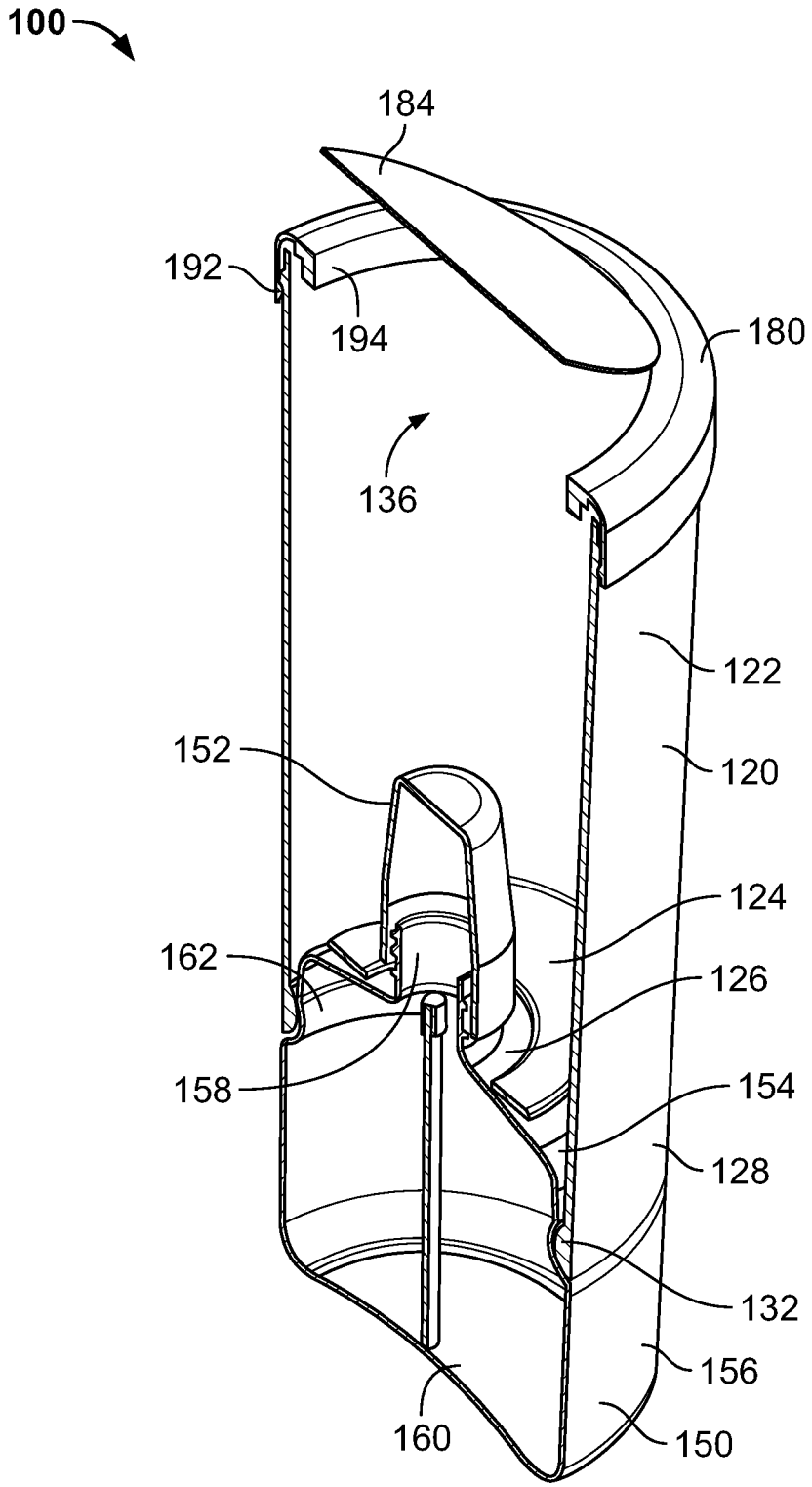
Figure 1D:
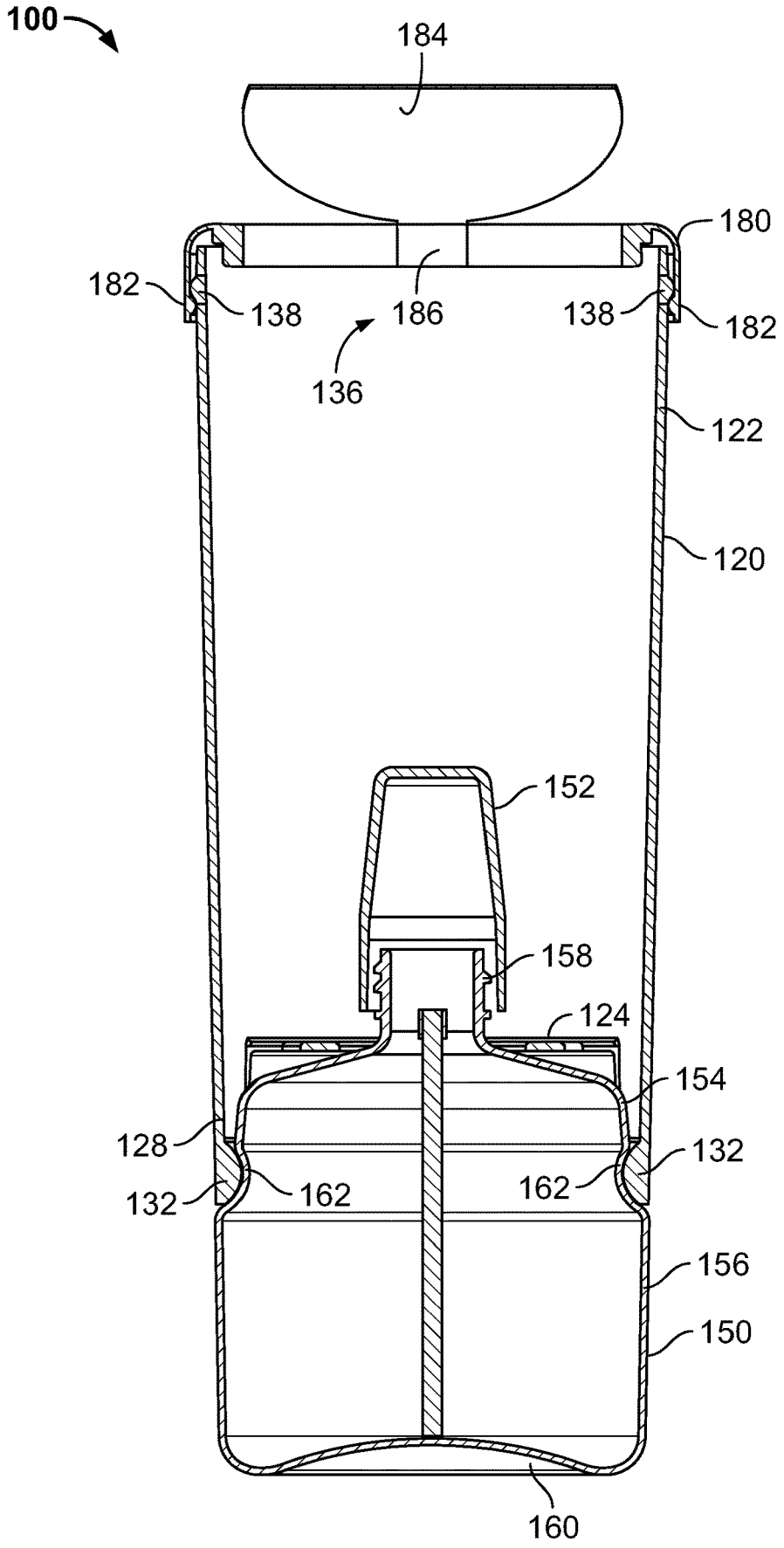
Figure 1E:
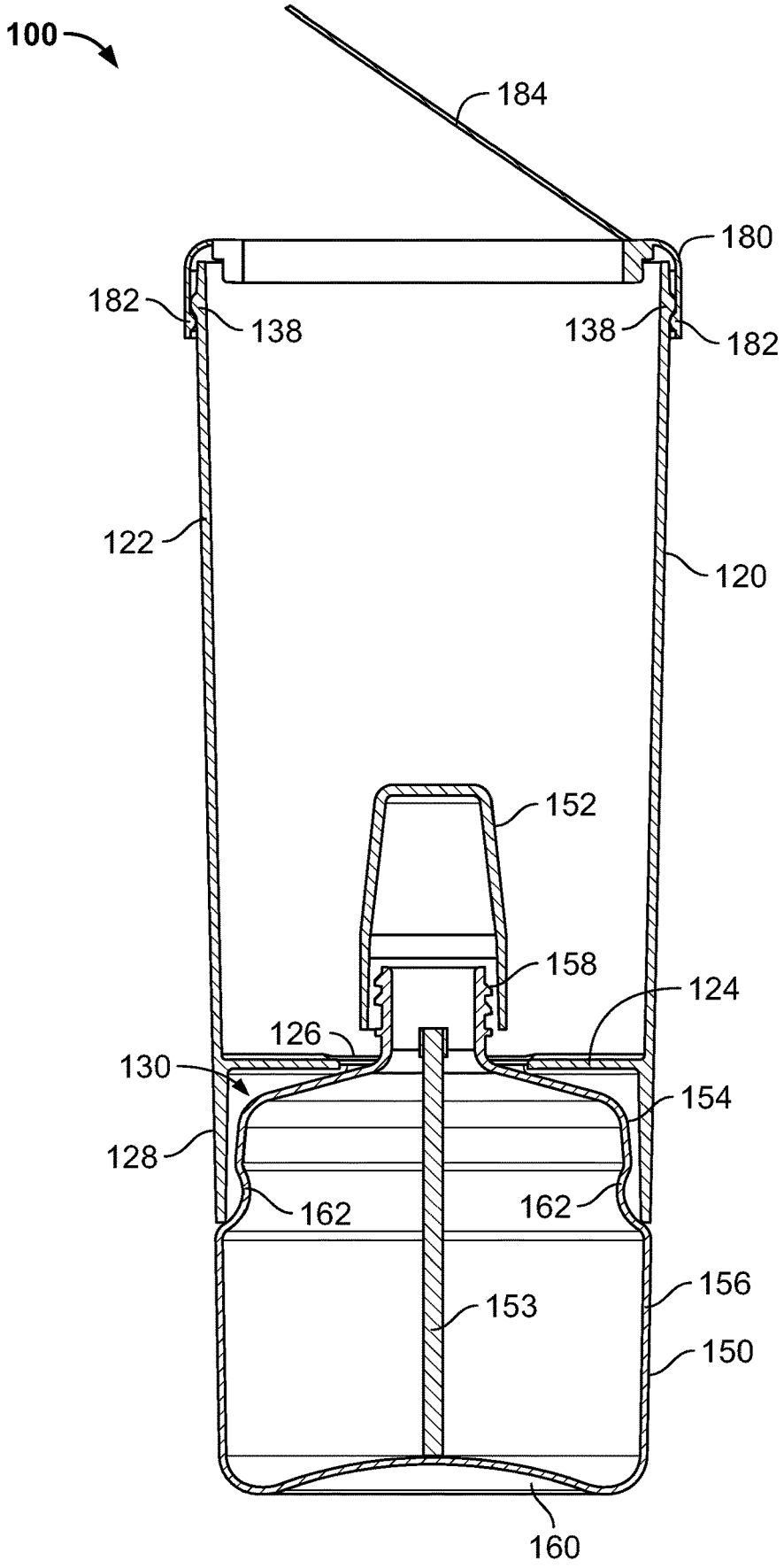
Figure 1F:
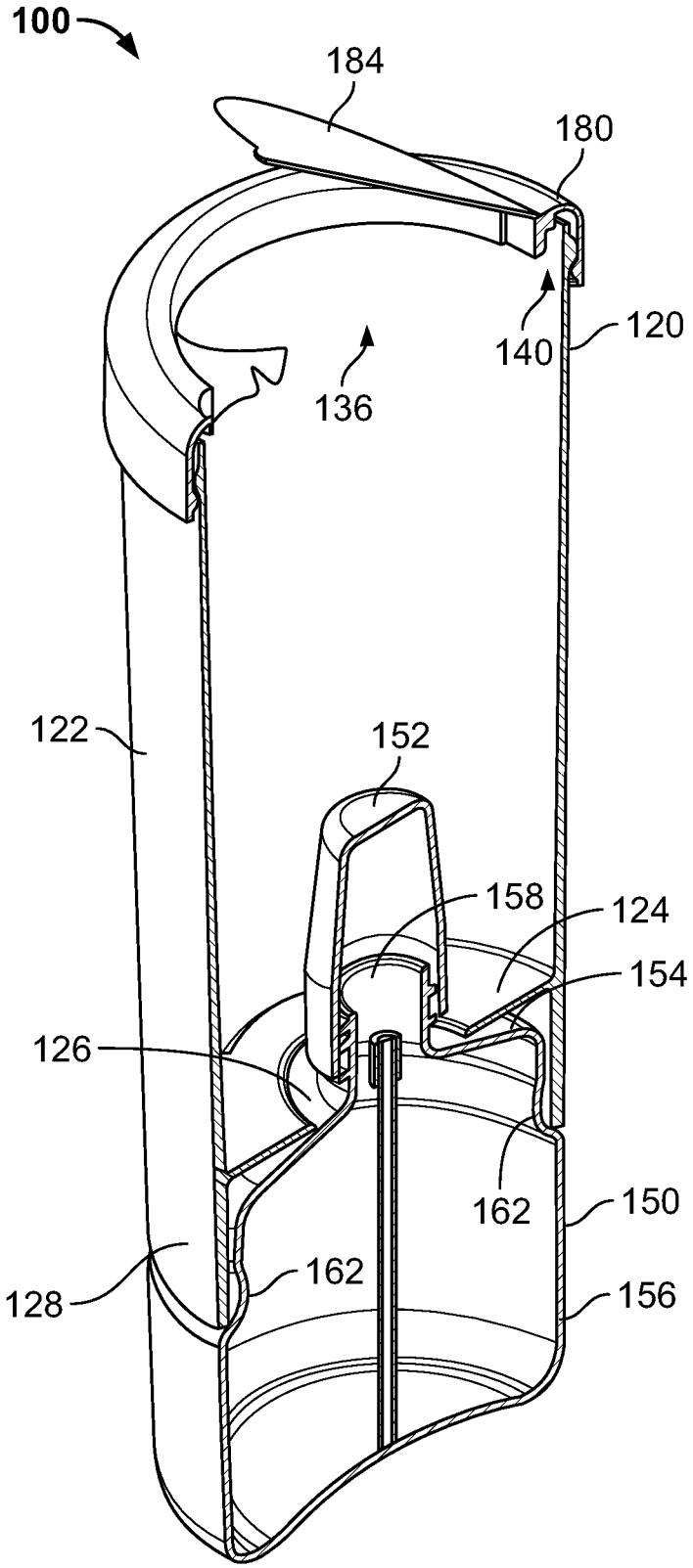
Figure 1G:
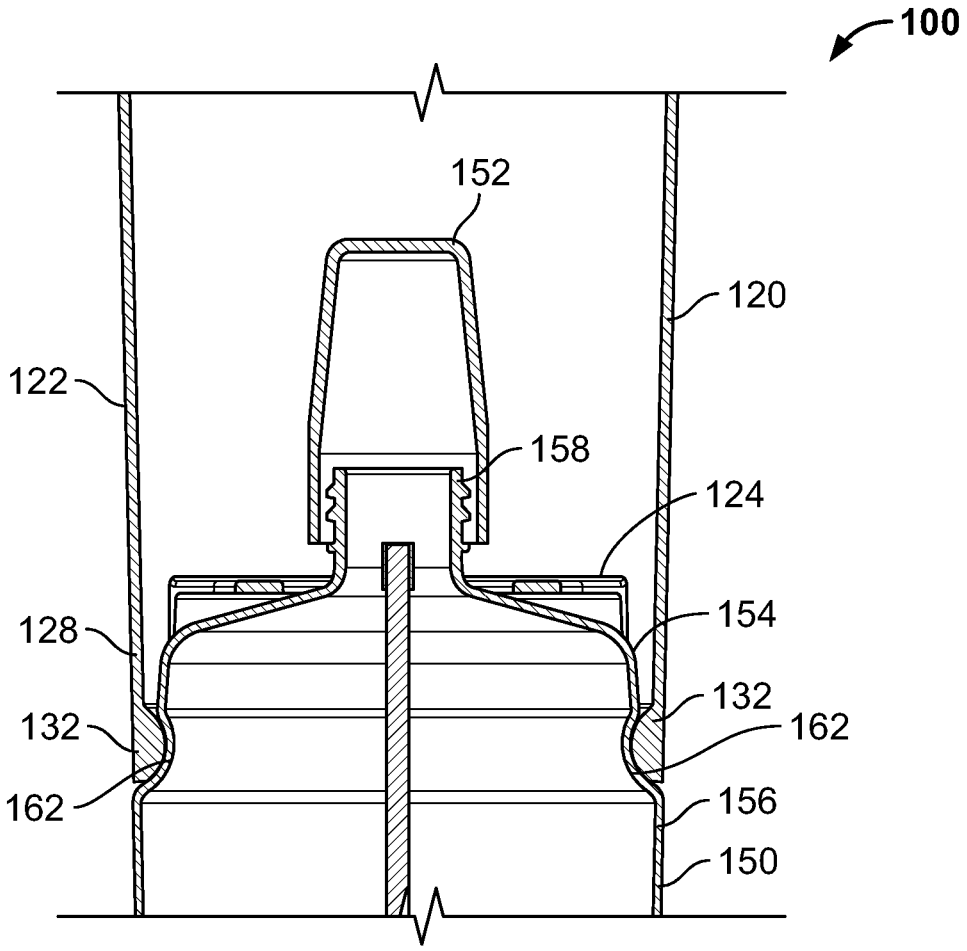
Figure 1H:
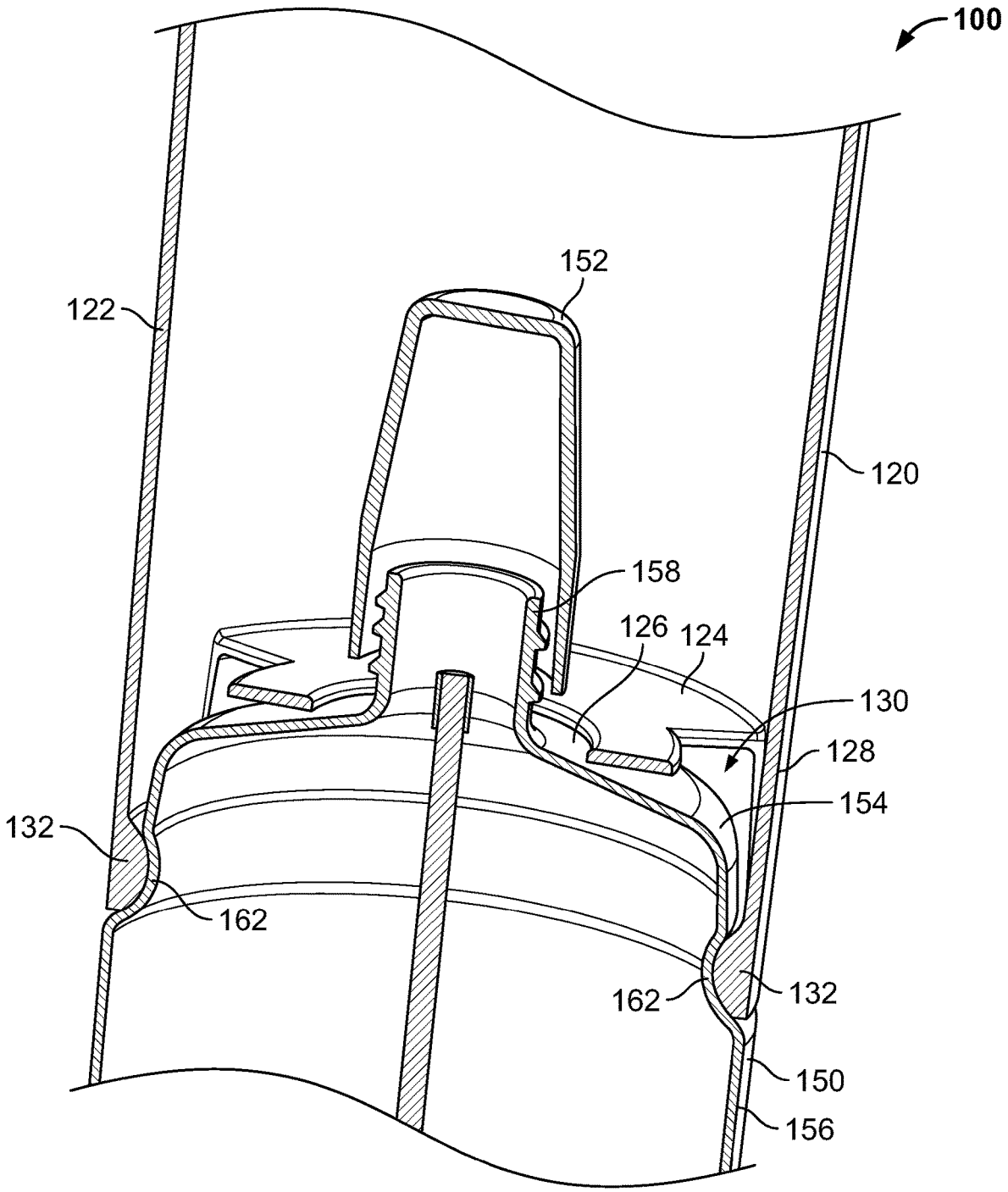
Figure 1J:
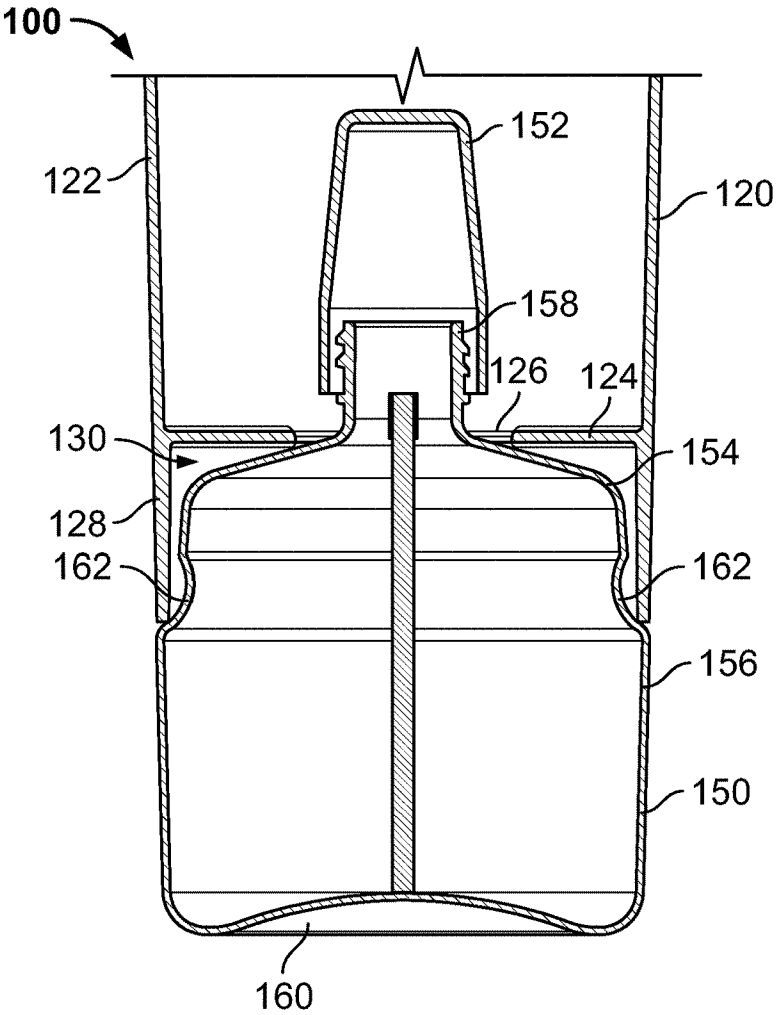
Figure 1I:
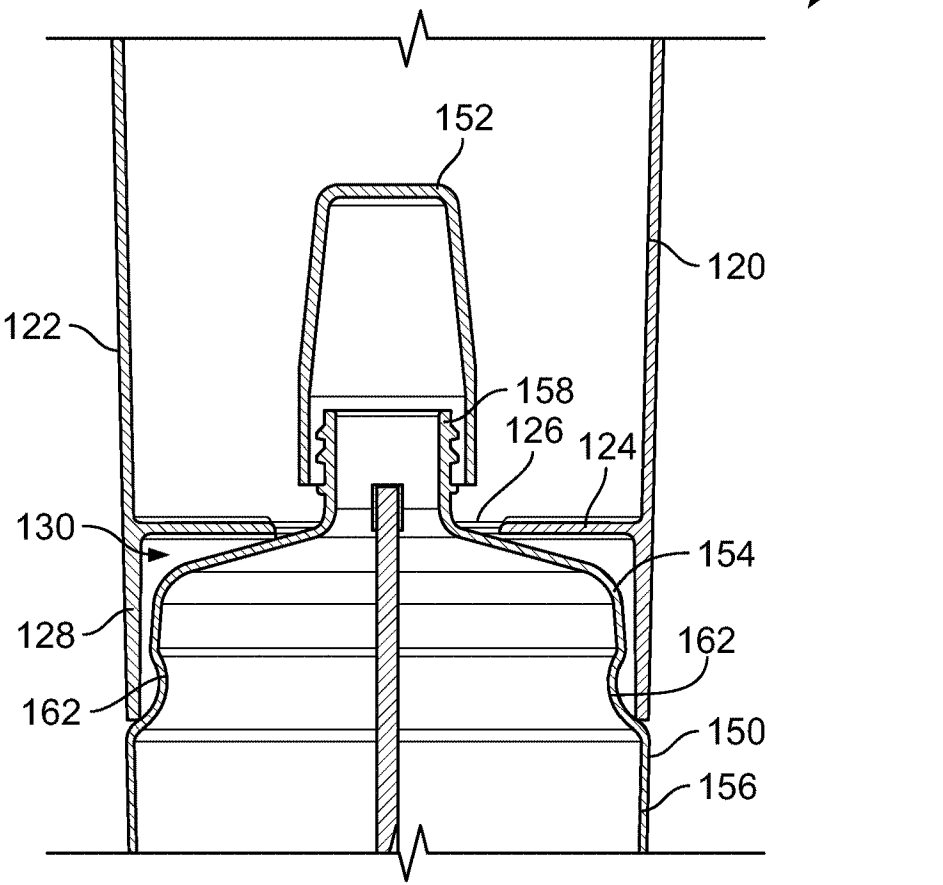
Figure 1K:
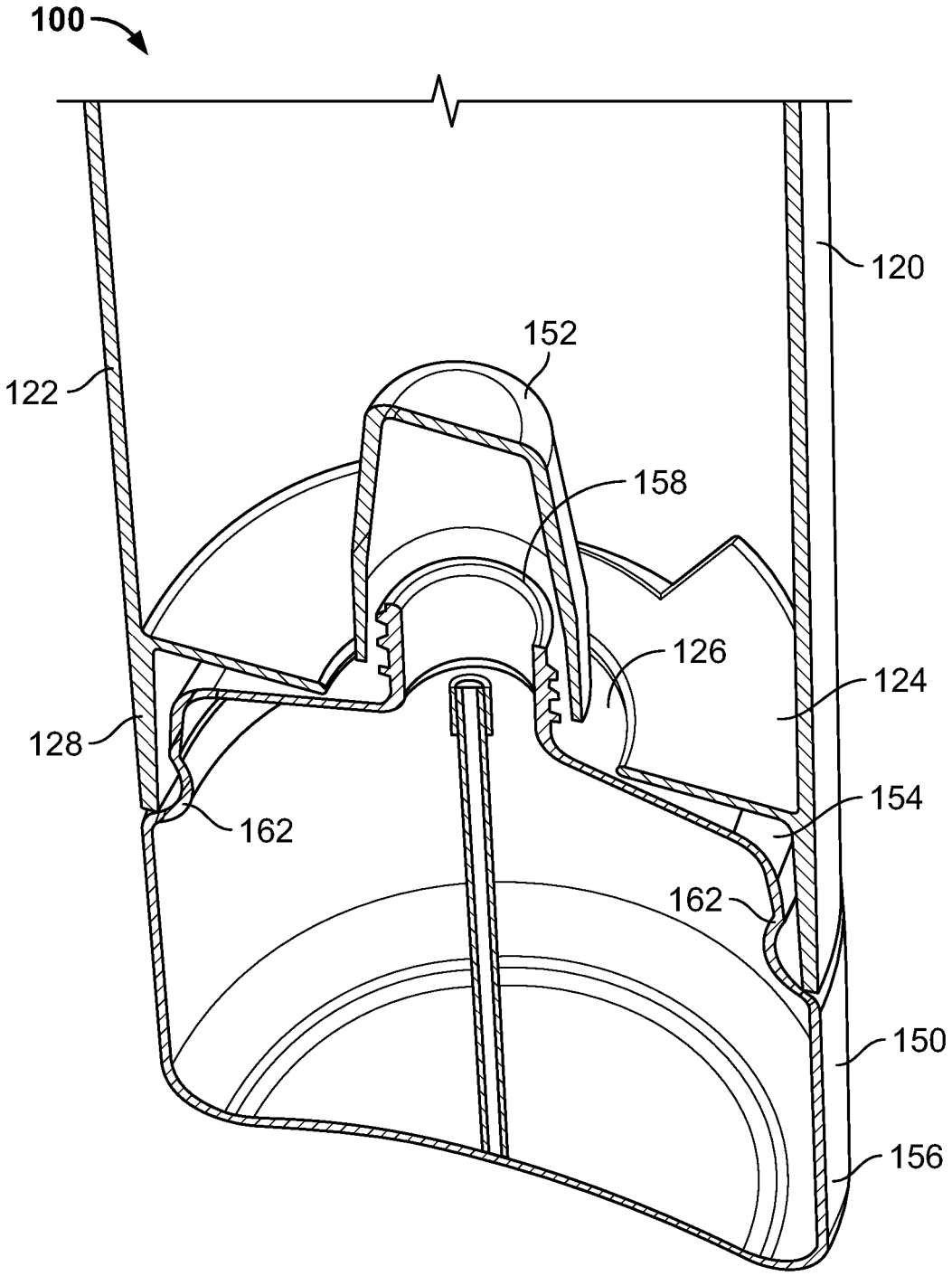
Figure 1L:
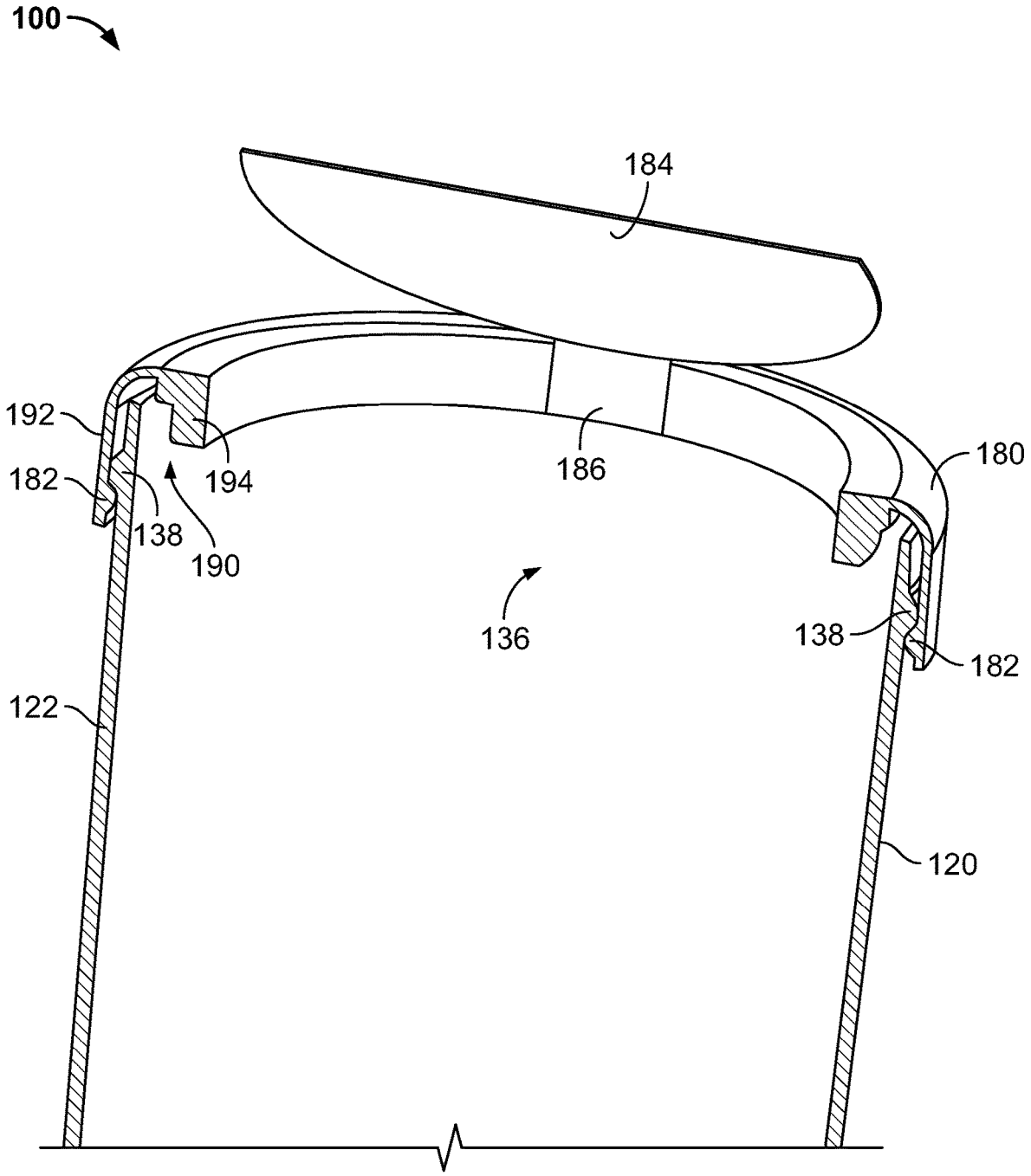
Figure 1M:
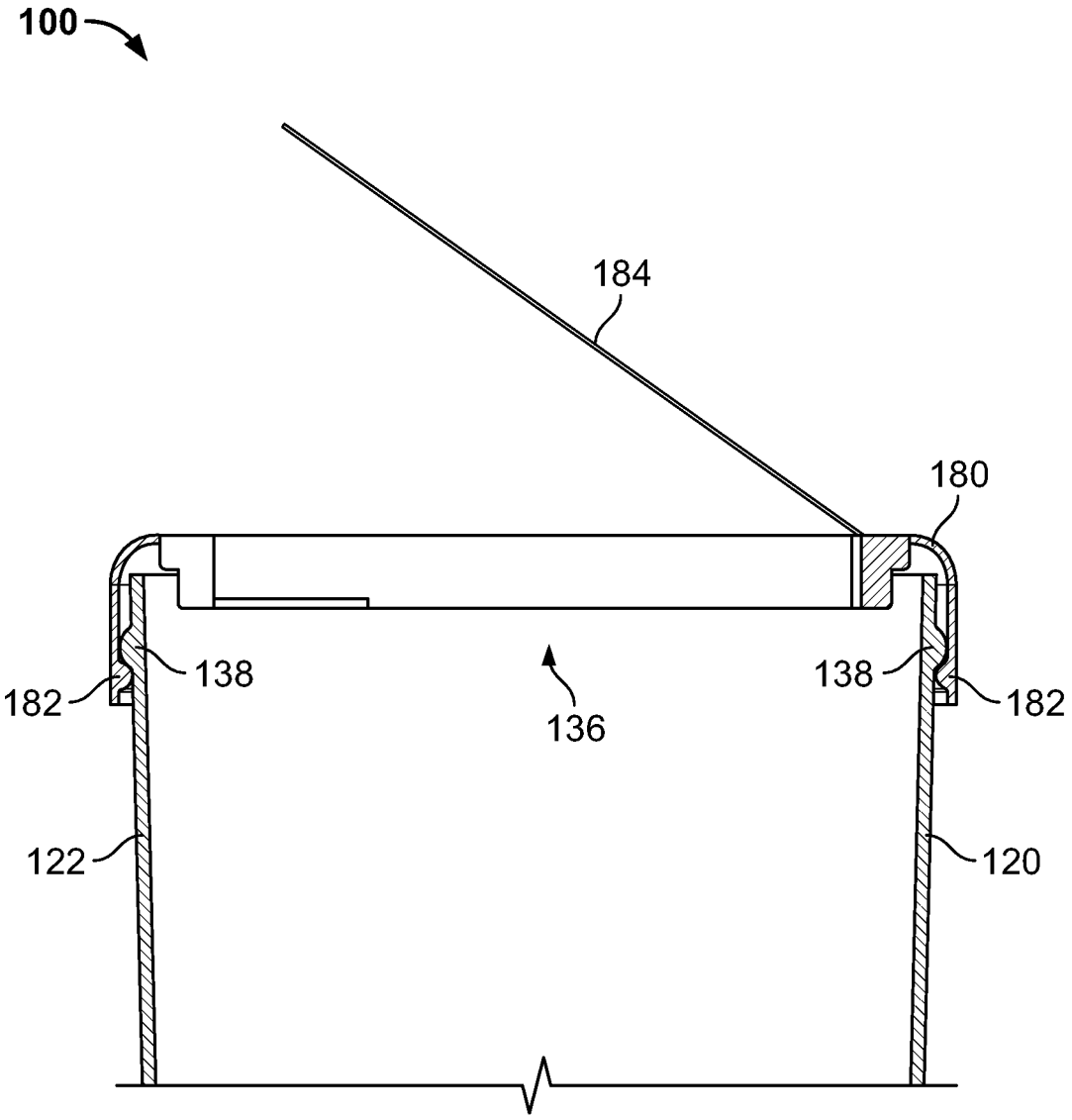
Figure 1N:
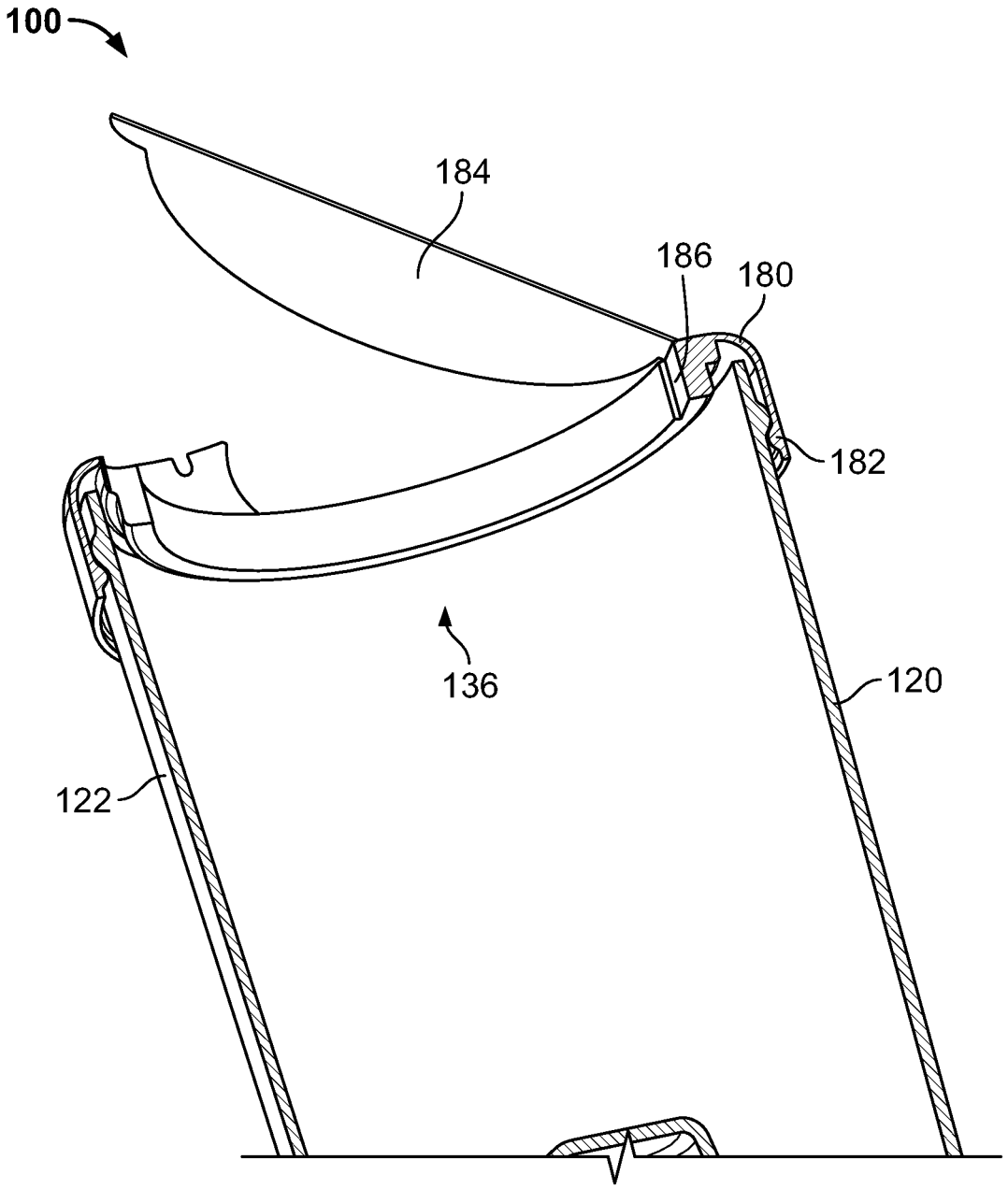
Figure 1O:
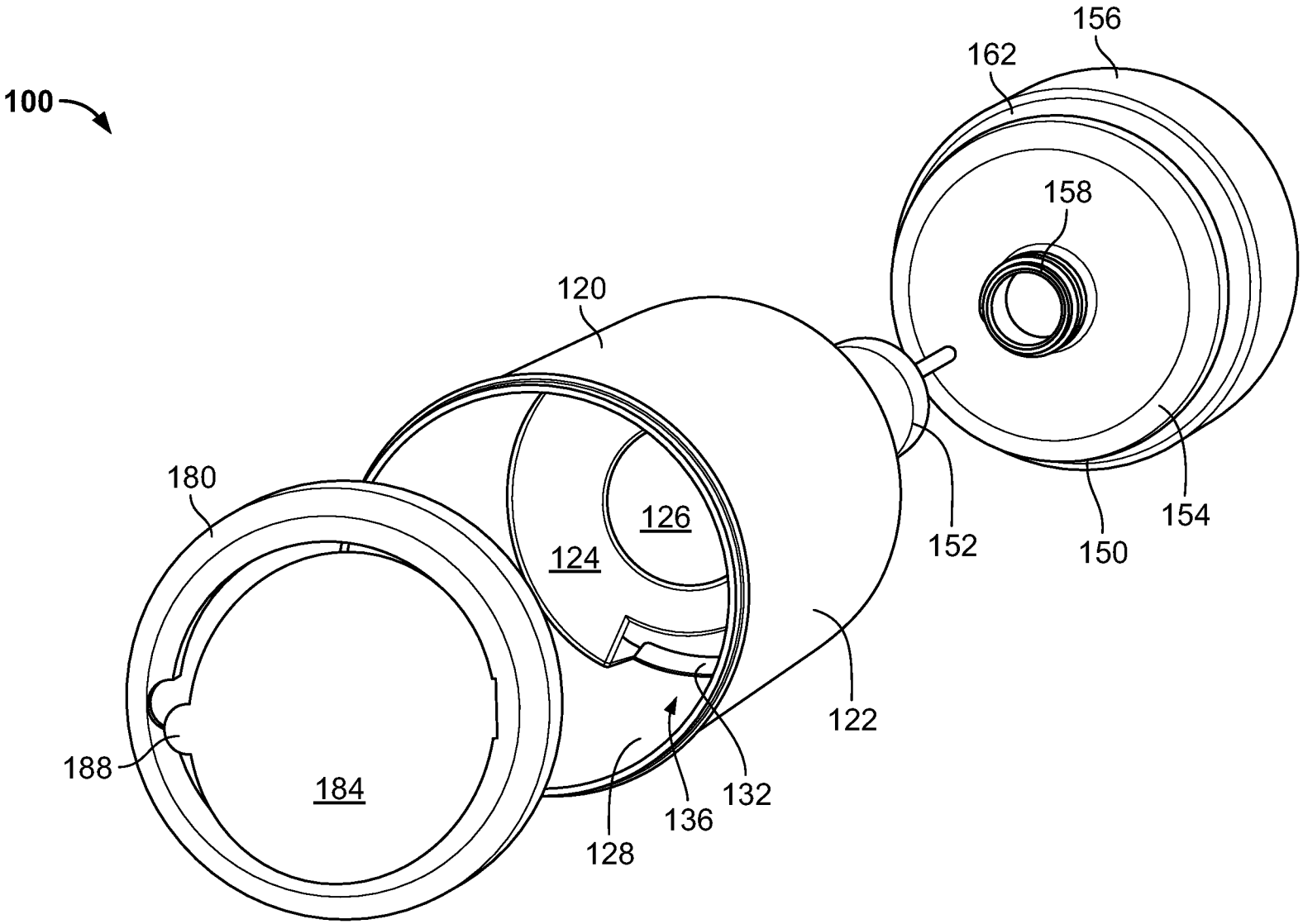
Figure 1P:
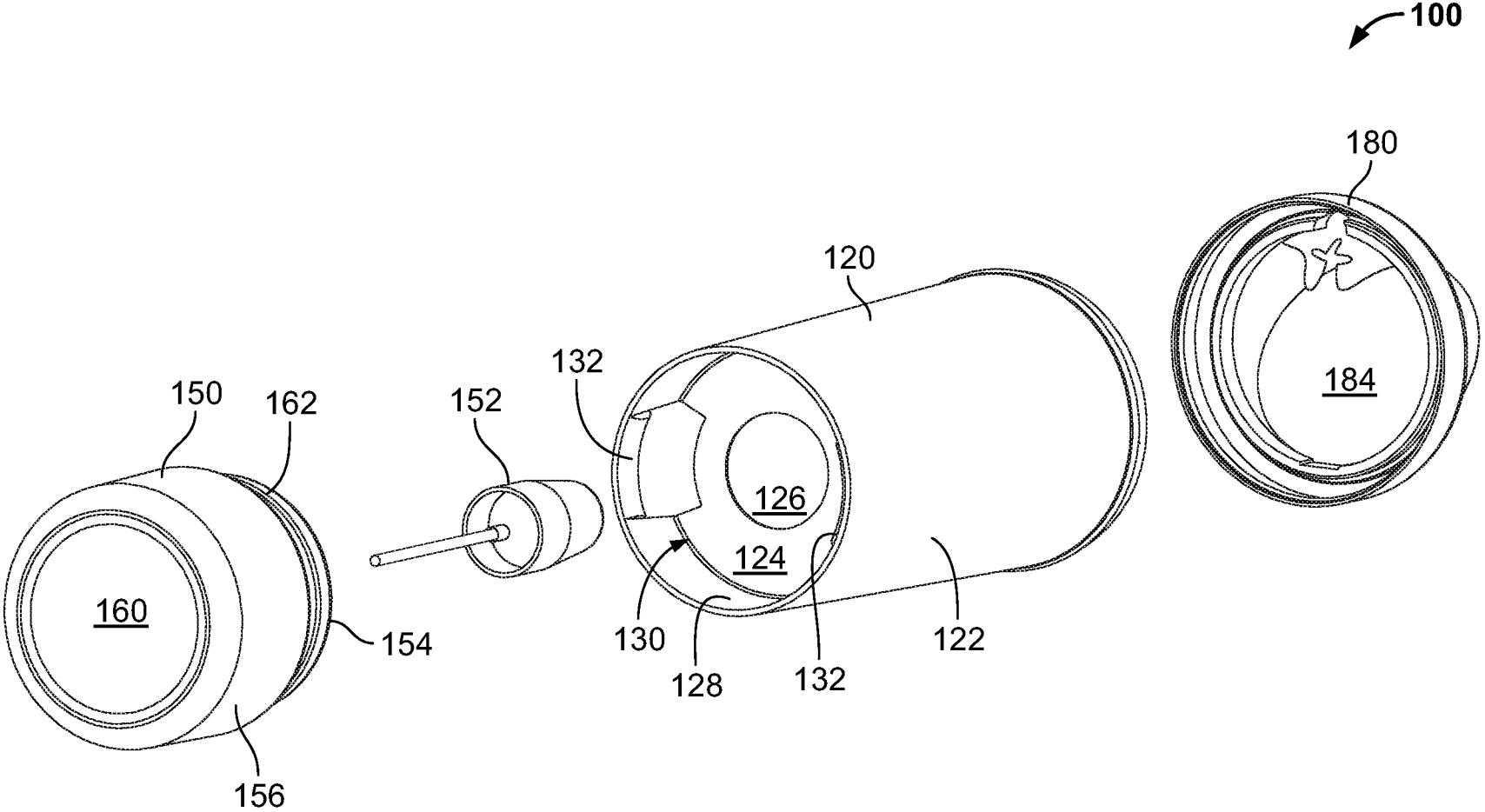
Figure 1Q:
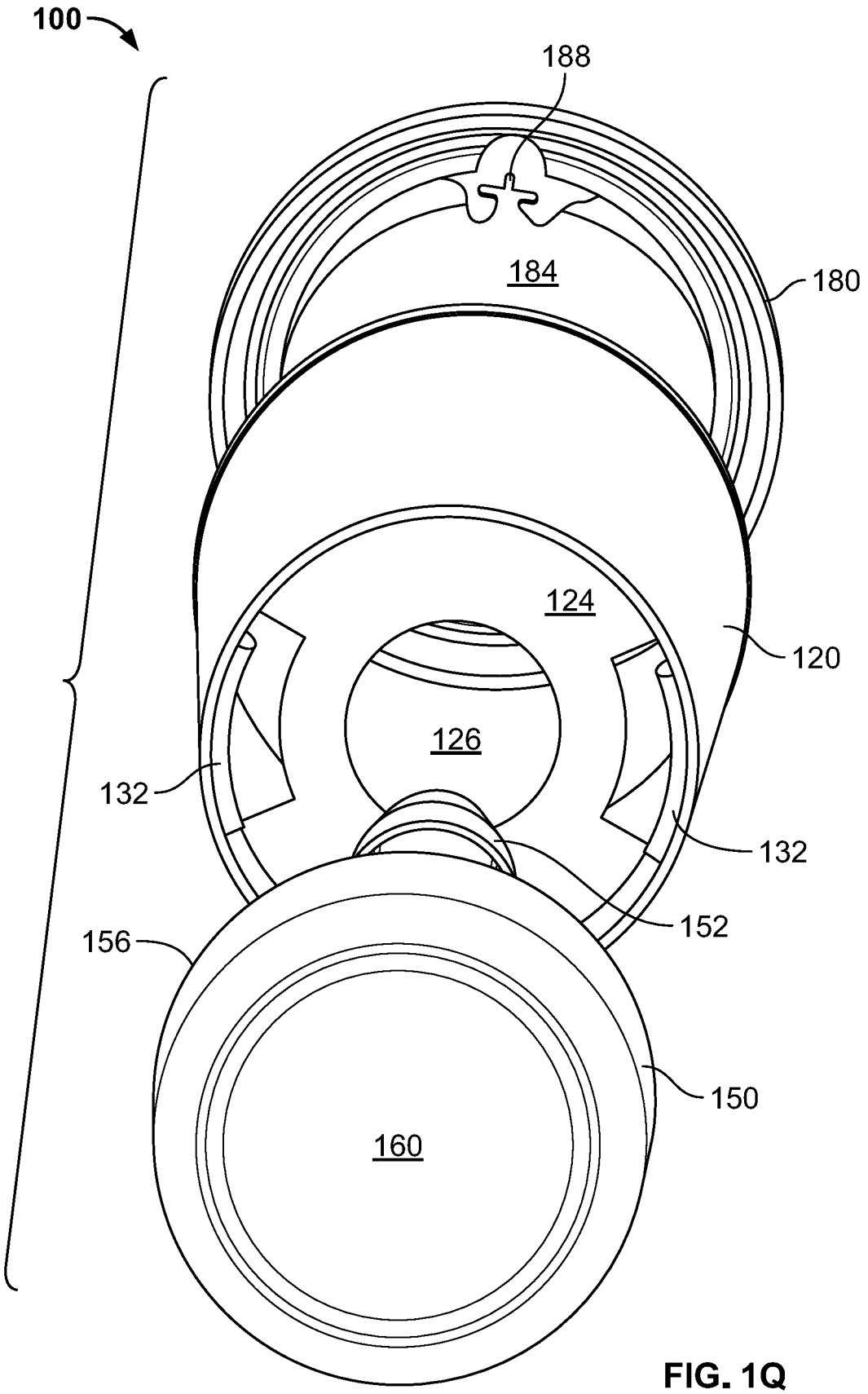

The description that follows describes, illustrates and exemplifies one or more embodiments of the instant disclosure in accordance with its principles. This description is not provided to limit the disclosure to the embodiments described herein, but rather to explain and teach the principles of the embodiments in order to enable one of ordinary skill in the art to understand these principles and, with that understanding, be able to apply them to practice not only the embodiments described herein, but also any other embodiment that may come to mind in accordance with these principles. The scope of this disclosure is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers or serial numbers in cases where such labeling facilitates a more clear description. Additionally, the drawings set forth herein are not necessarily drawn to scale, and in some instances proportions may have been exaggerated to more clearly depict certain features. As stated above, this specification is intended to be taken as a whole and interpreted in accordance with the principles of the disclosure as taught herein and understood by one of ordinary skill in the art.

The modular dispenser system and its components described herein can enable users to carry and use items and liquids that can be used together in a convenient, cost effective, and portable manner. The system can include a body, a bottle that is removably secured to the body, and a cover removably engaged to the body. When the body, bottle, and cover are secured together, it may form a unitary object. In this way, a user can easily carry and store the system and its items and liquids simultaneously. For example, the body and bottle may together or individually fit into standard cup holders in automobiles, or in other compartments of automobiles and the like. As another example, the body and bottle may together or individually stand upright on a surface, such as a shelf or table, for example.

The body and bottle can respectively contain a variety of items and liquids. For example, the body can contain dry items, including towels (including microfiber towels), towelettes, or wipes for a variety of household, industrial, or commercial purposes. The bottle can contain a liquid or a liquid formulation, such as a cleaning agent for use as a cleaner, a stain remover, a protectant, or a conditioner, for example, for use on various surfaces, including for example, a glass, a cloth, a fabric, a knit, a vinyl, a wool, a leather, a plastic, a steel, an aluminum, a rubber, a composite, a carpet, a painted object, or any other surface on which it is desired to dispense the liquid.

The dry items and the liquid formulation may be used together or separately, depending on the particular situation. In this way, a user can choose how to utilize the dry items and/or an amount of the liquid formulation, as needed. For example, a user may spray the liquid formulation on a surface in a desired amount then use the dry items to clean the surface. As another example, a user may spray the liquid formulation on the dry items in a desired amount, then use the now-moistened wipe to clean a surface. In a further example, a user may only need a dry wipe to absorb a spilled liquid or to pick up or off a solid object. In another example, a user may spray the liquid formulation on a surface and let it stand without wiping. Regardless, by using dry items in these exemplary manners, there is no possibility of a wet wipe drying out before it can be used.

The amount of liquid formulation contained in the bottle may be greater than the amount of liquid formulation present in pre-moistened wet wipes. For example, the amount of liquid formulation contained in the bottle may be double the amount of liquid formulation present in wet wipes. As such, users may be able to perform more cleaning tasks when using the modular dispenser system described herein, as compared to using wet wipes.

Dry items, such as dry wipes, may be composed of materials that may not work well for wet wipes. For example, wet wipes may be made of a material that would disintegrate or break apart when used with certain liquid formulations, and wet wipes may not be able to be moistened or remain moistened with certain liquid formulations. In contrast, the materials used for dry items can be more durable and/or have desirable cleaning features, as compared to the materials used for wet wipes. As such, users may be able to use a dry item longer (or use a lesser number of dry items) when performing cleaning tasks, as compared to using pre-moistened wet wipes.

Figure 1R:
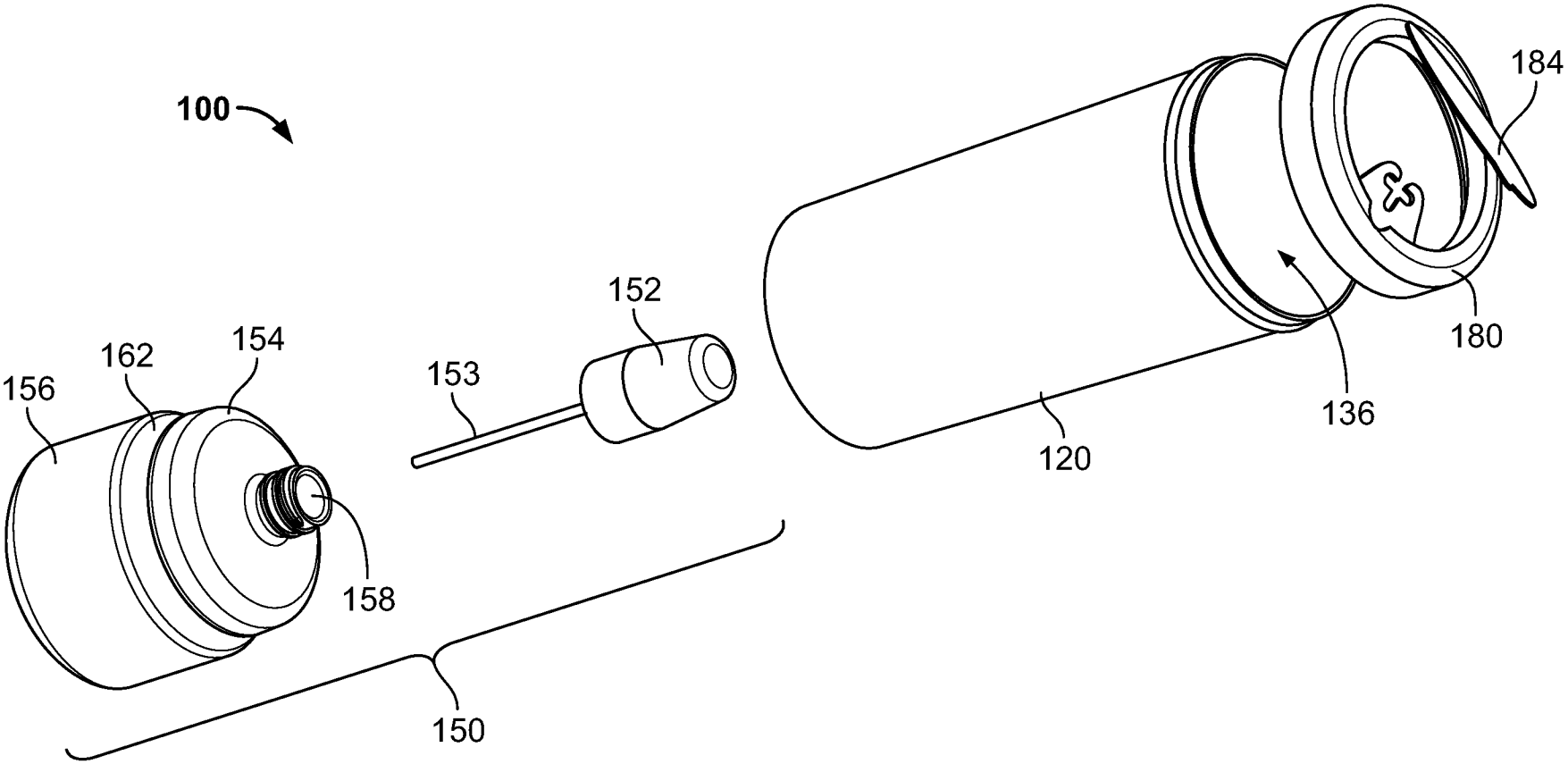
Figure 2A:
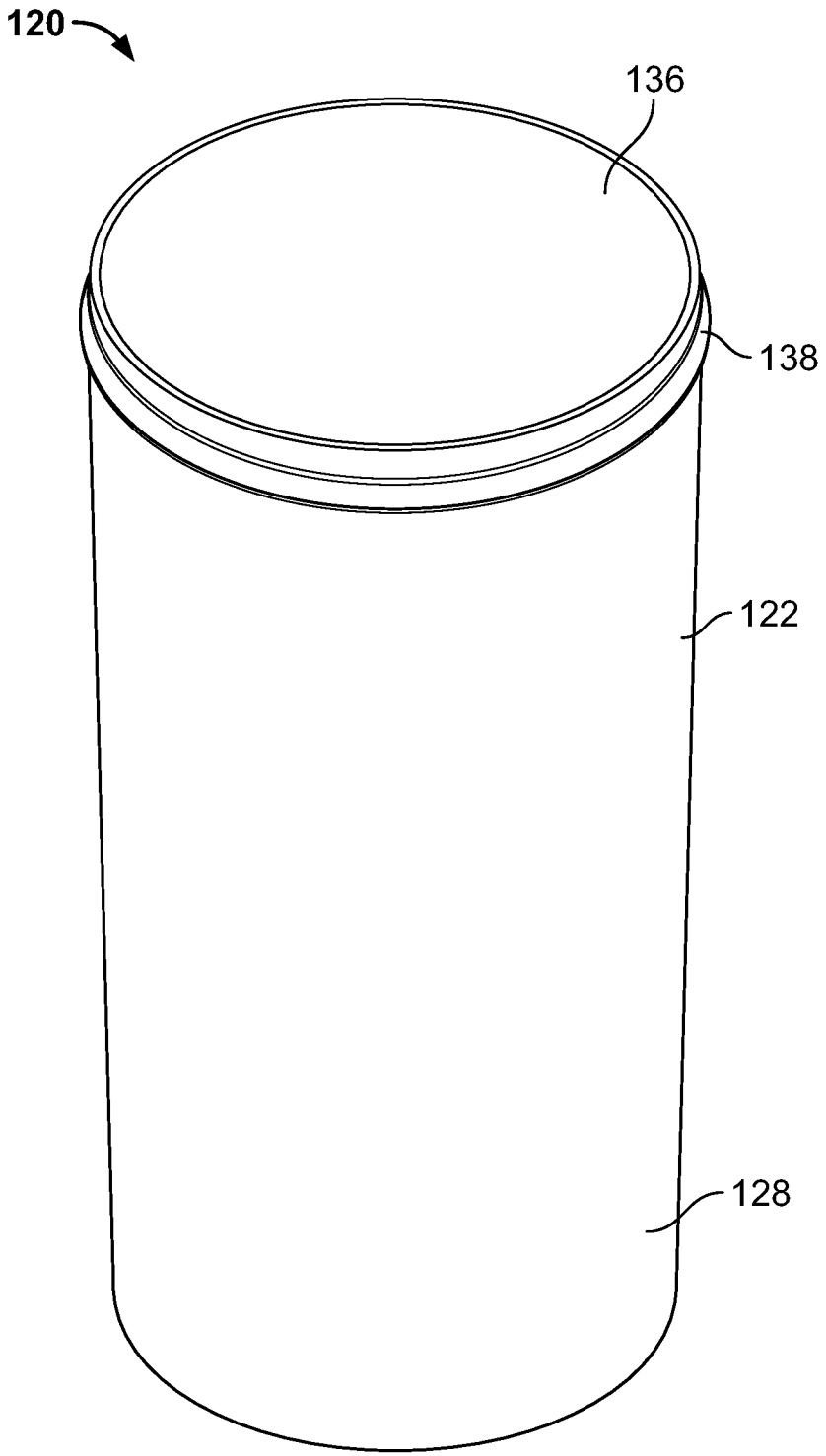
FIGS. 2A-2P are views of embodiments of the body of the modular dispenser system of the instant disclosure.
Figure 2B:
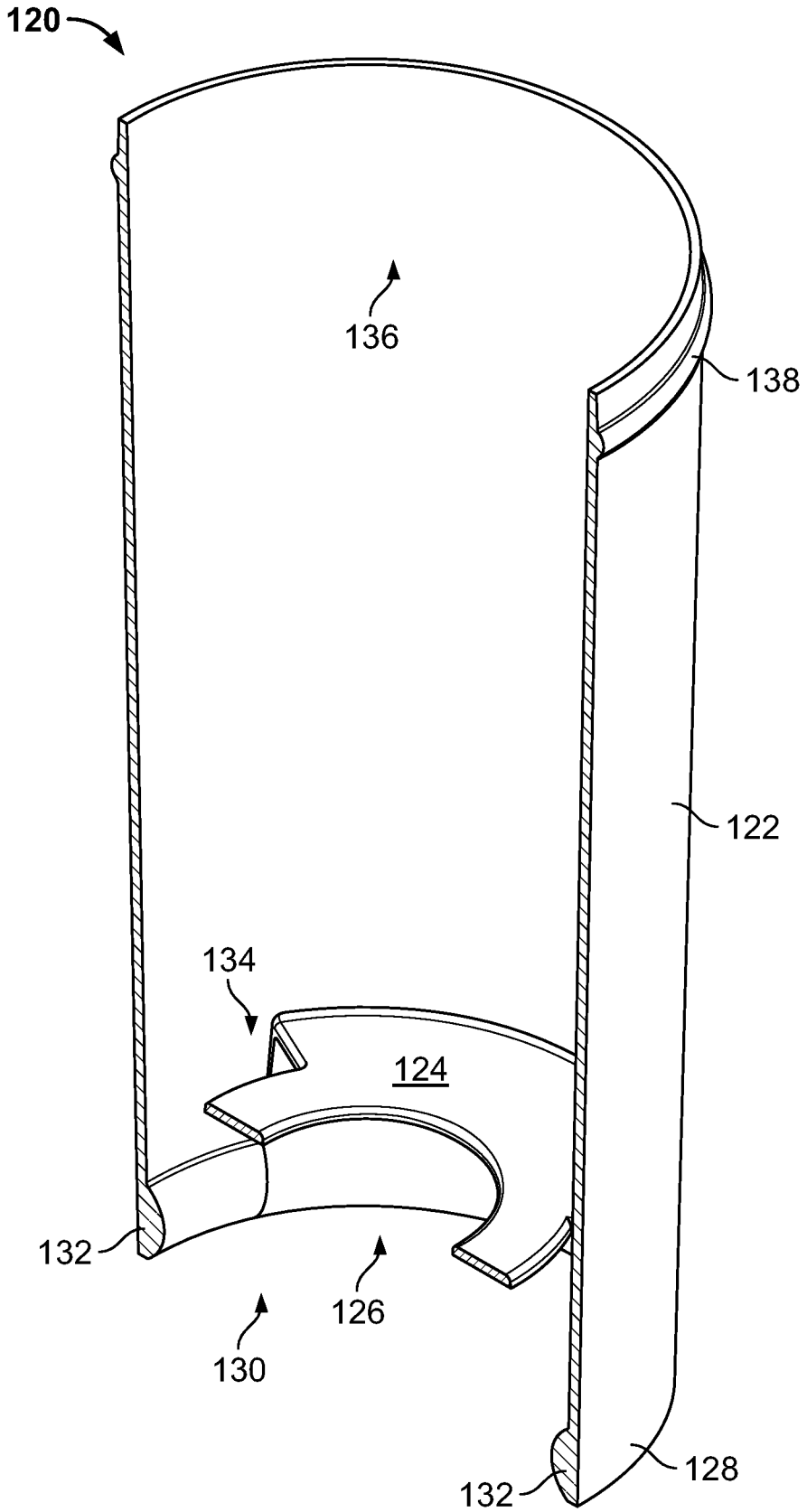
Figure 2C:
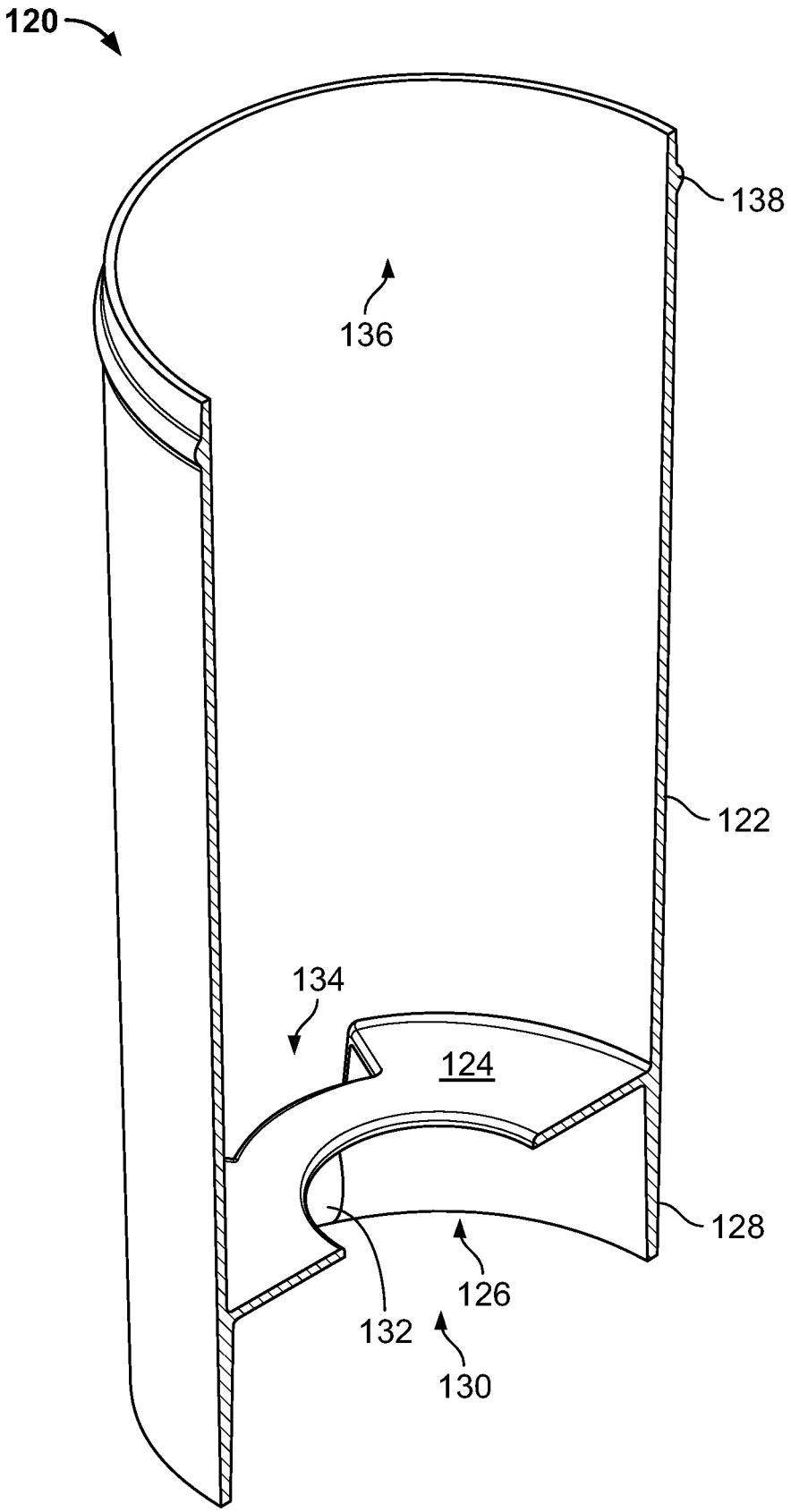
Figure 2D:
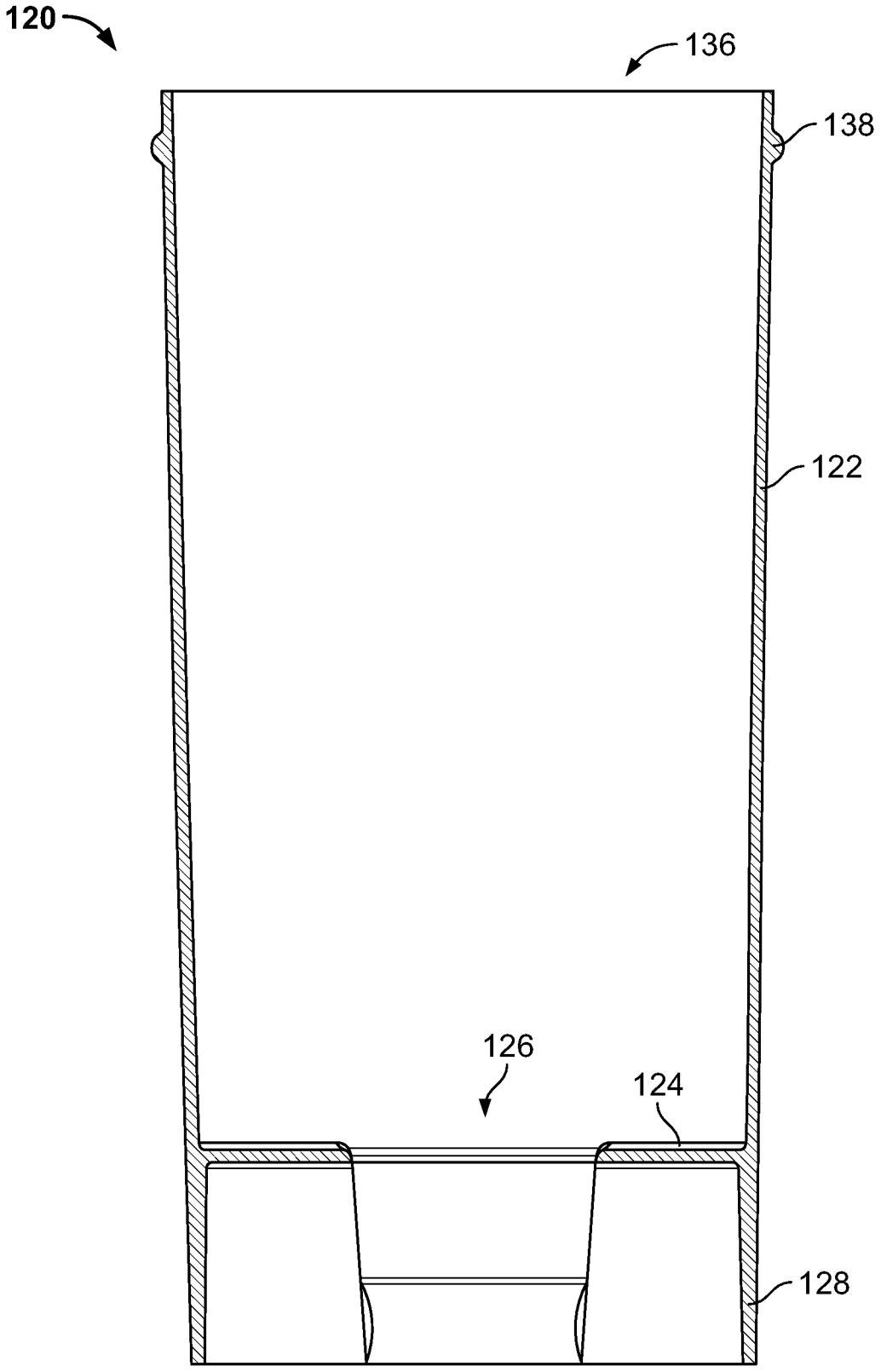
Figure 2E:
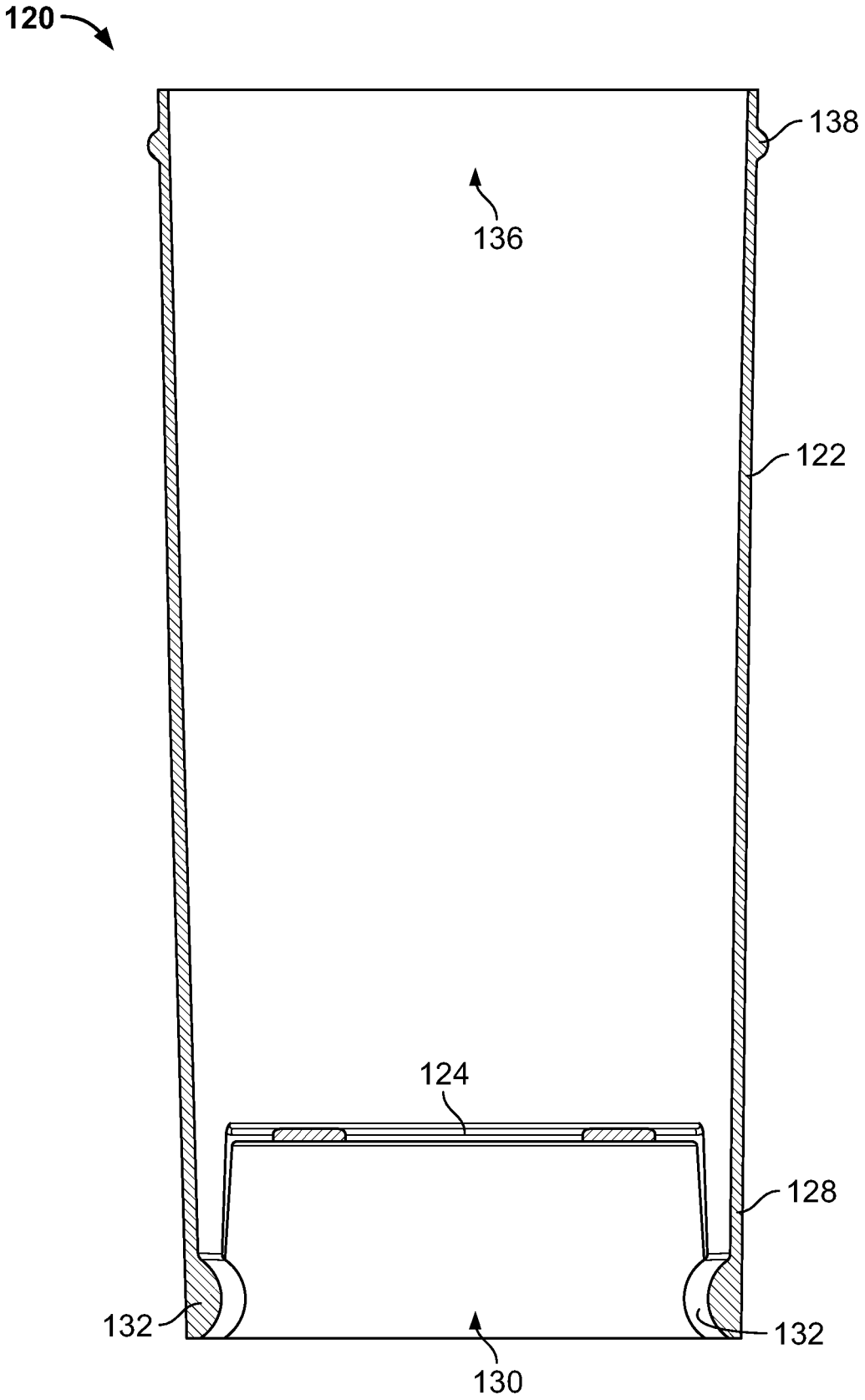
Figure 2F:
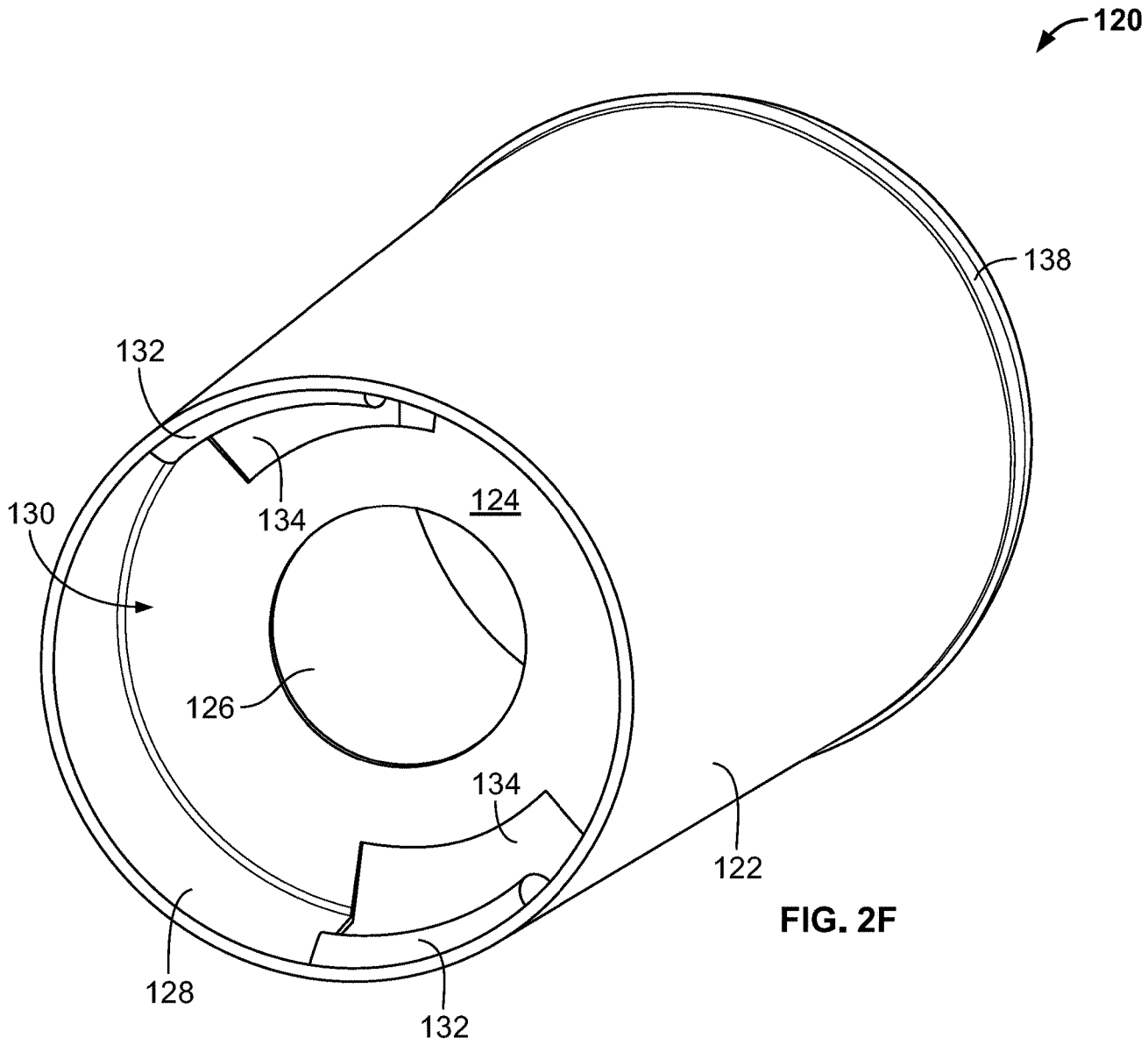
Figure 2G:
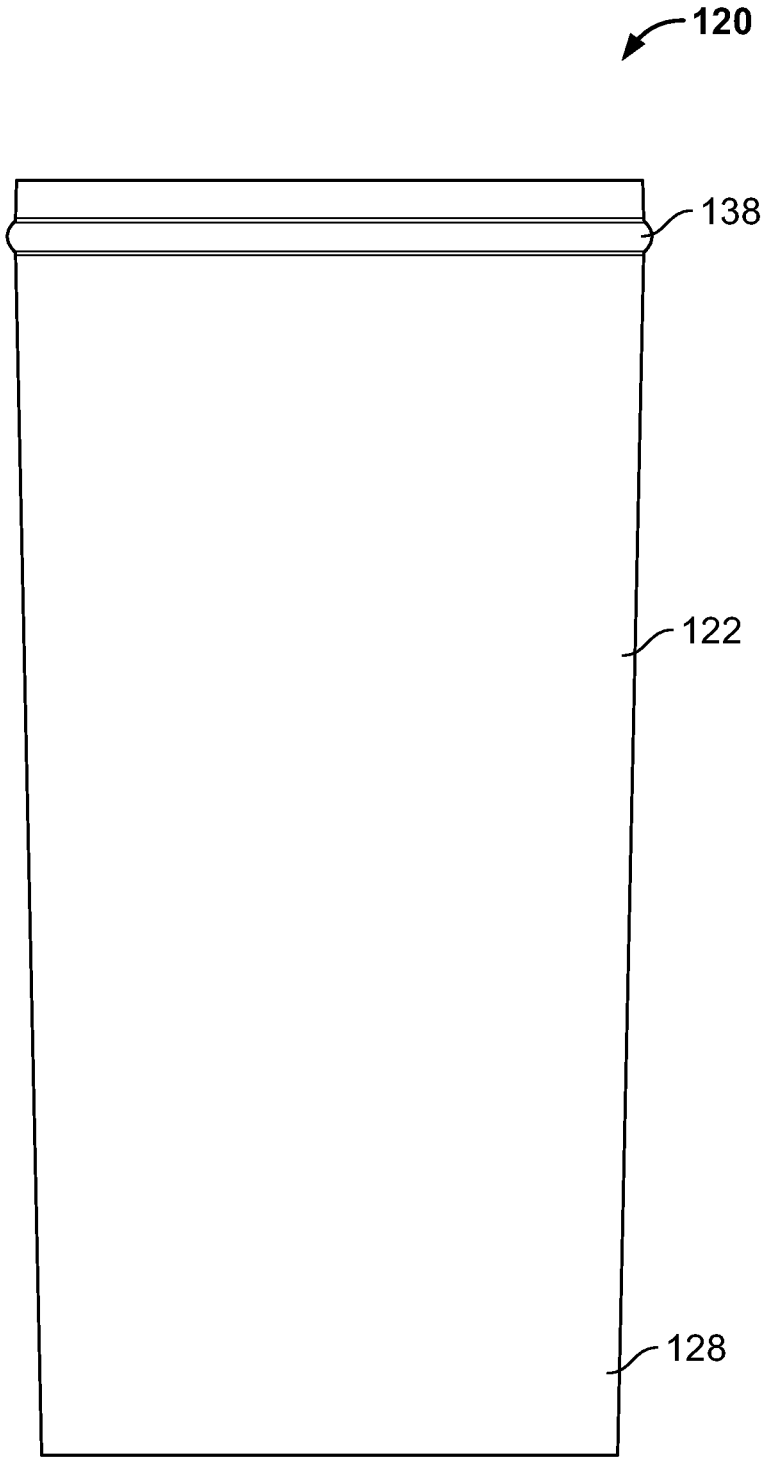
Figure 2H:
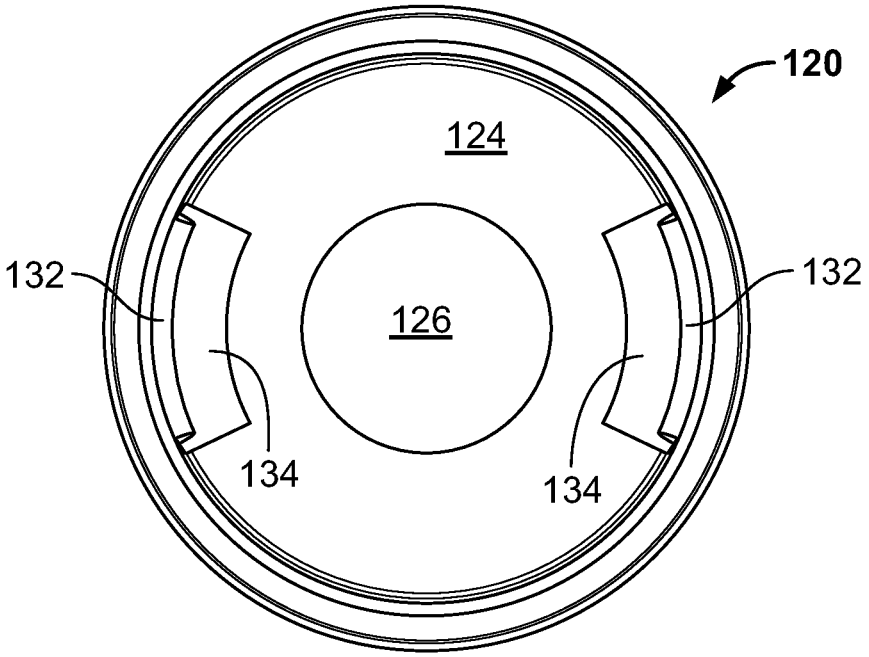
Figure 2I:
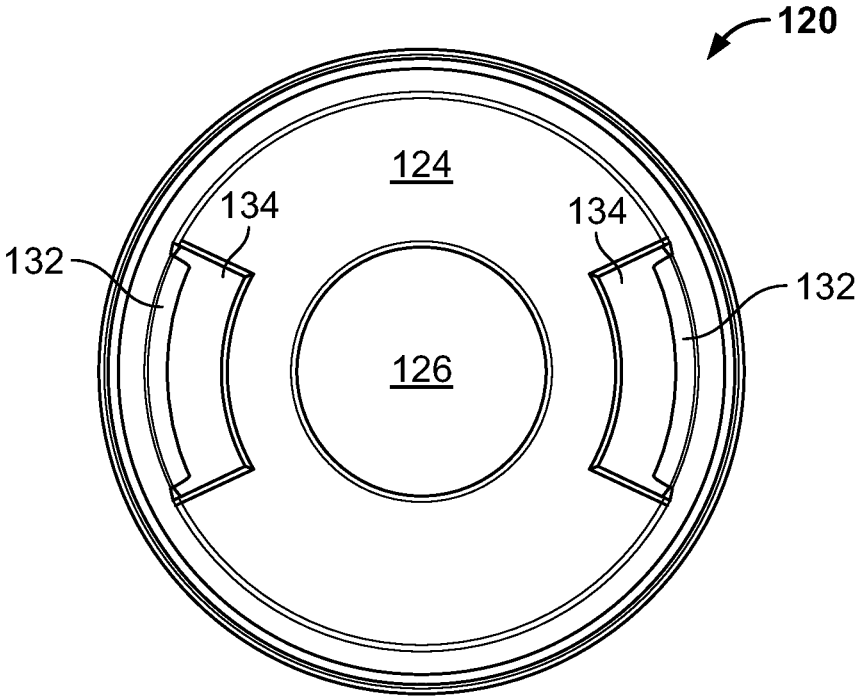
Figure 2J:
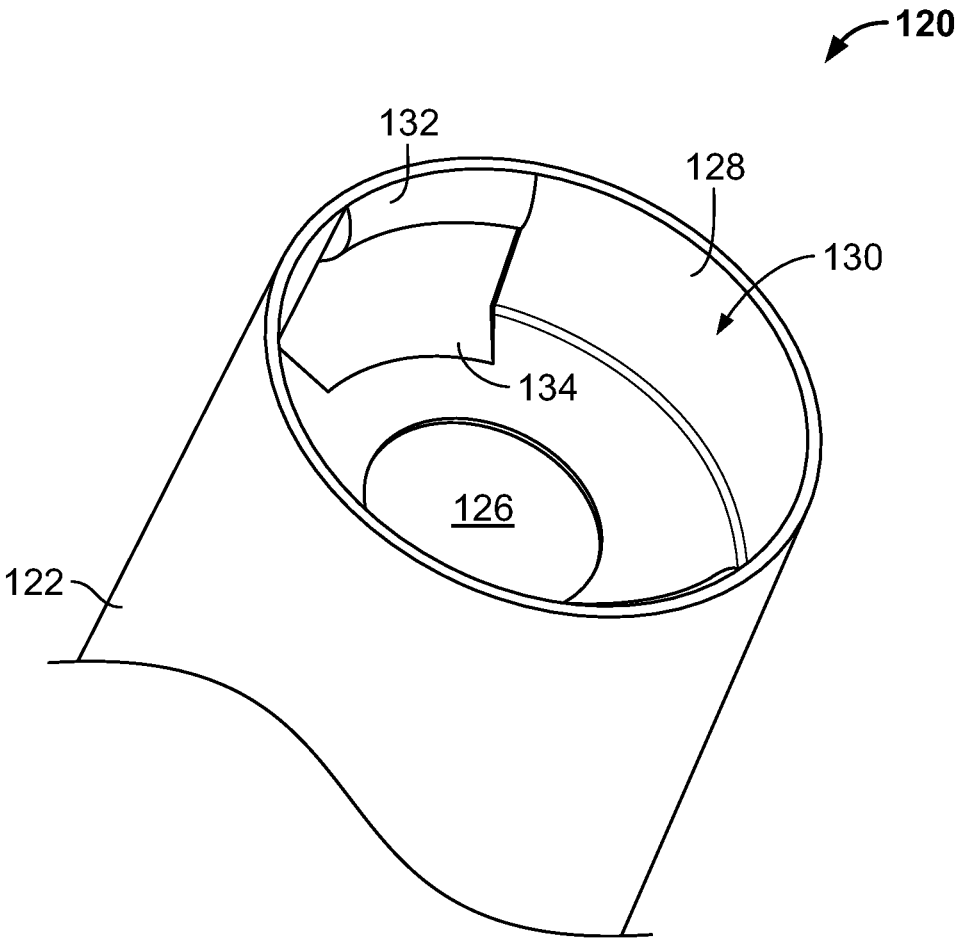
Figure 2K:
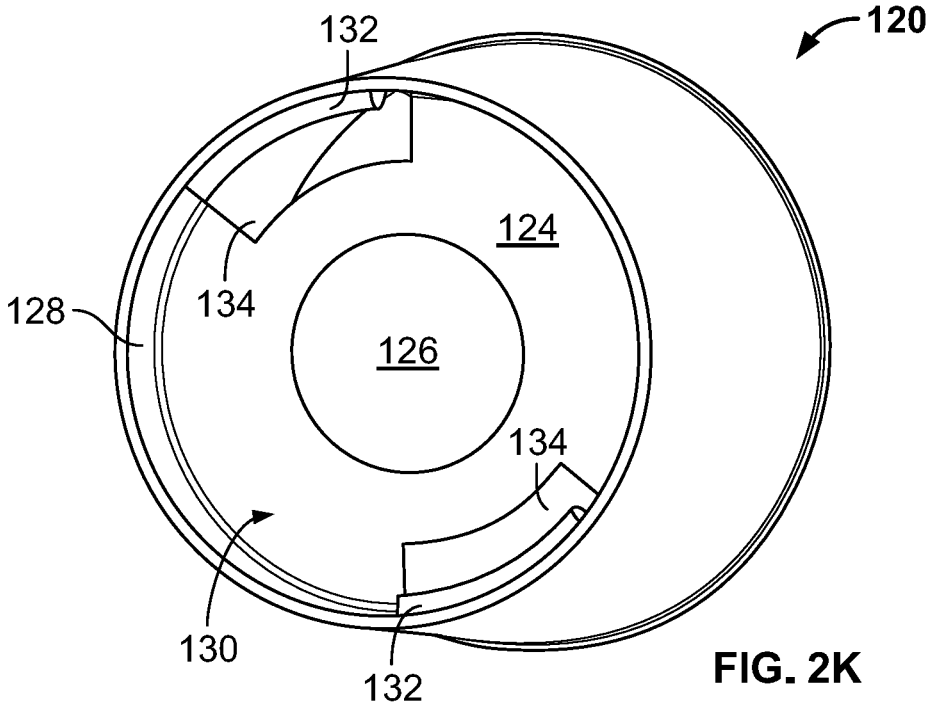
Figure 2L:
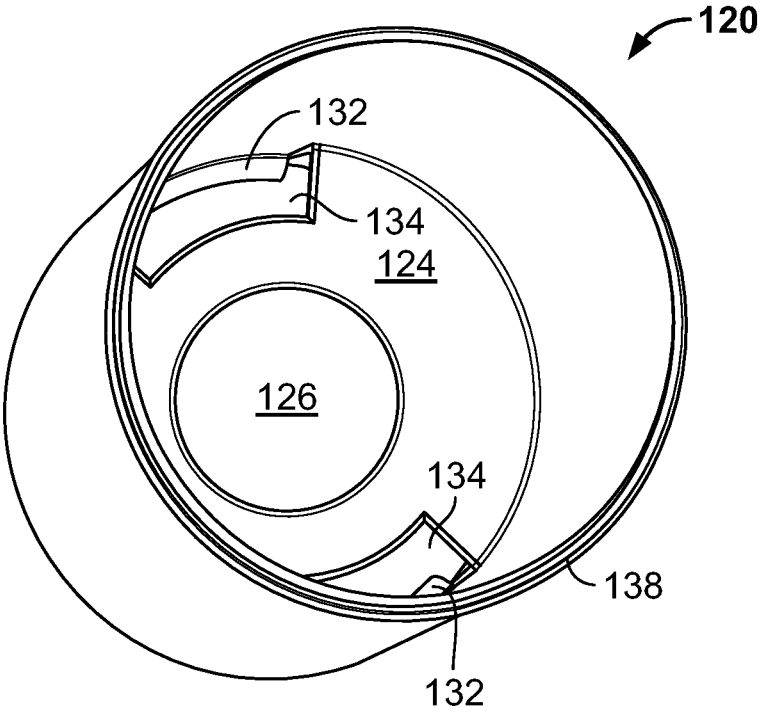
Figure 2M:
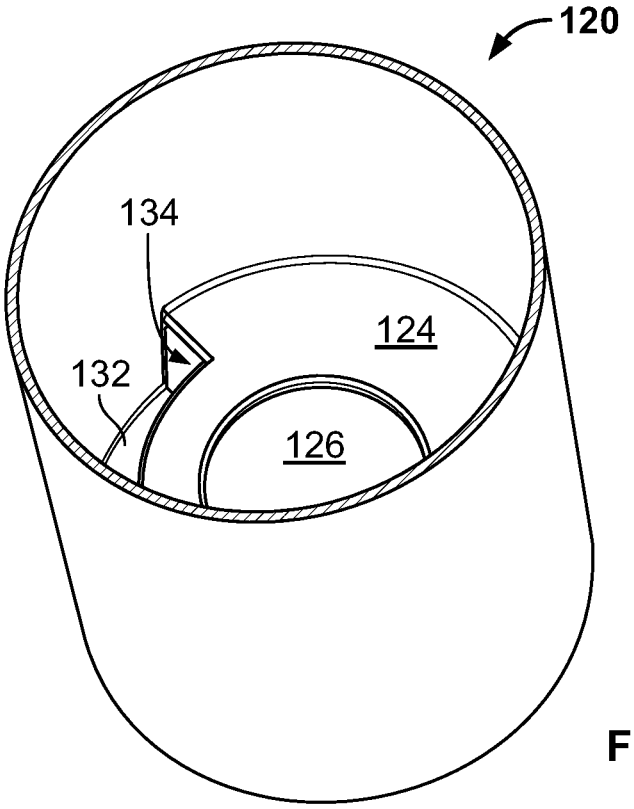
Figure 2N:
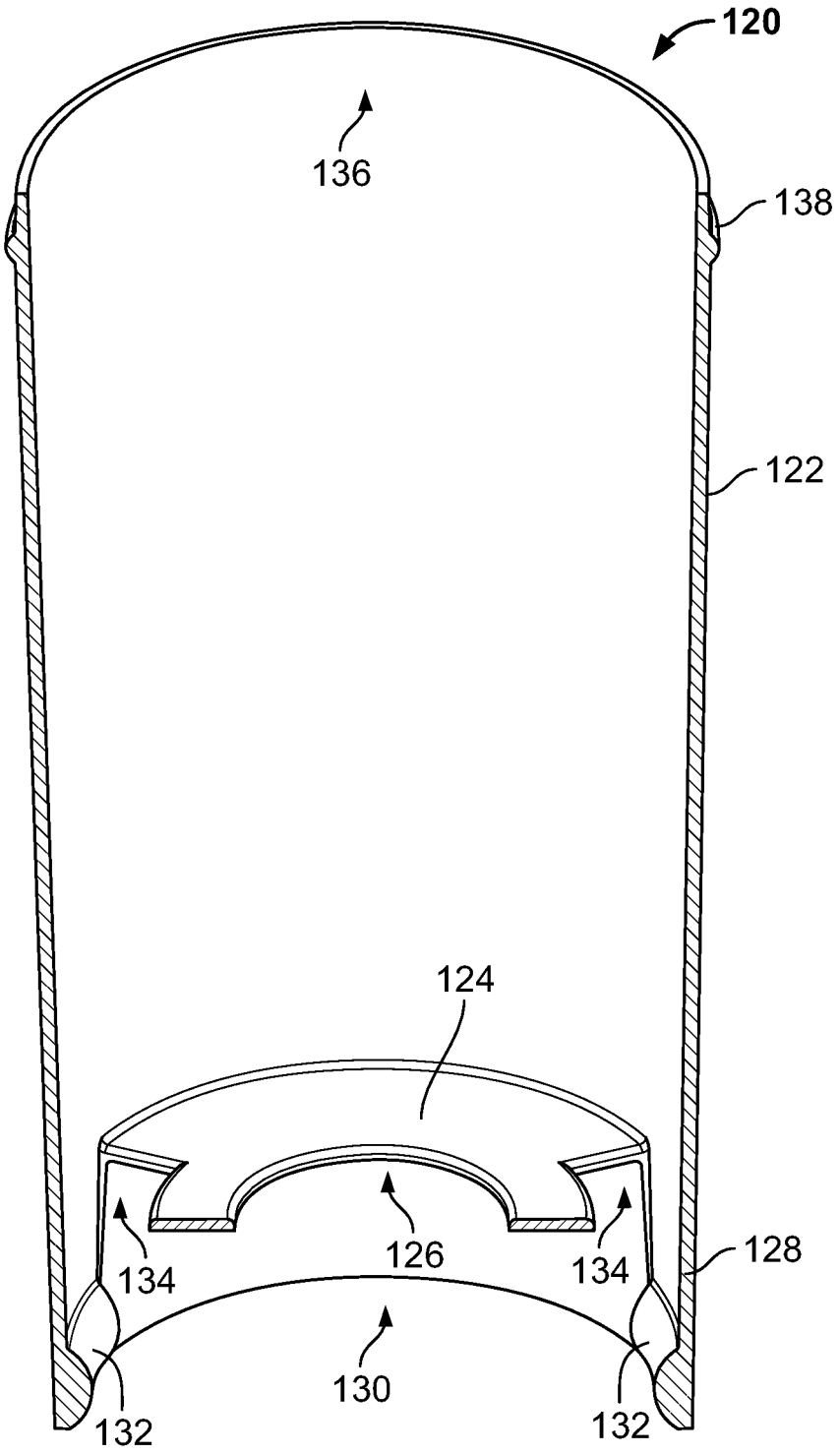
Figure 2O:
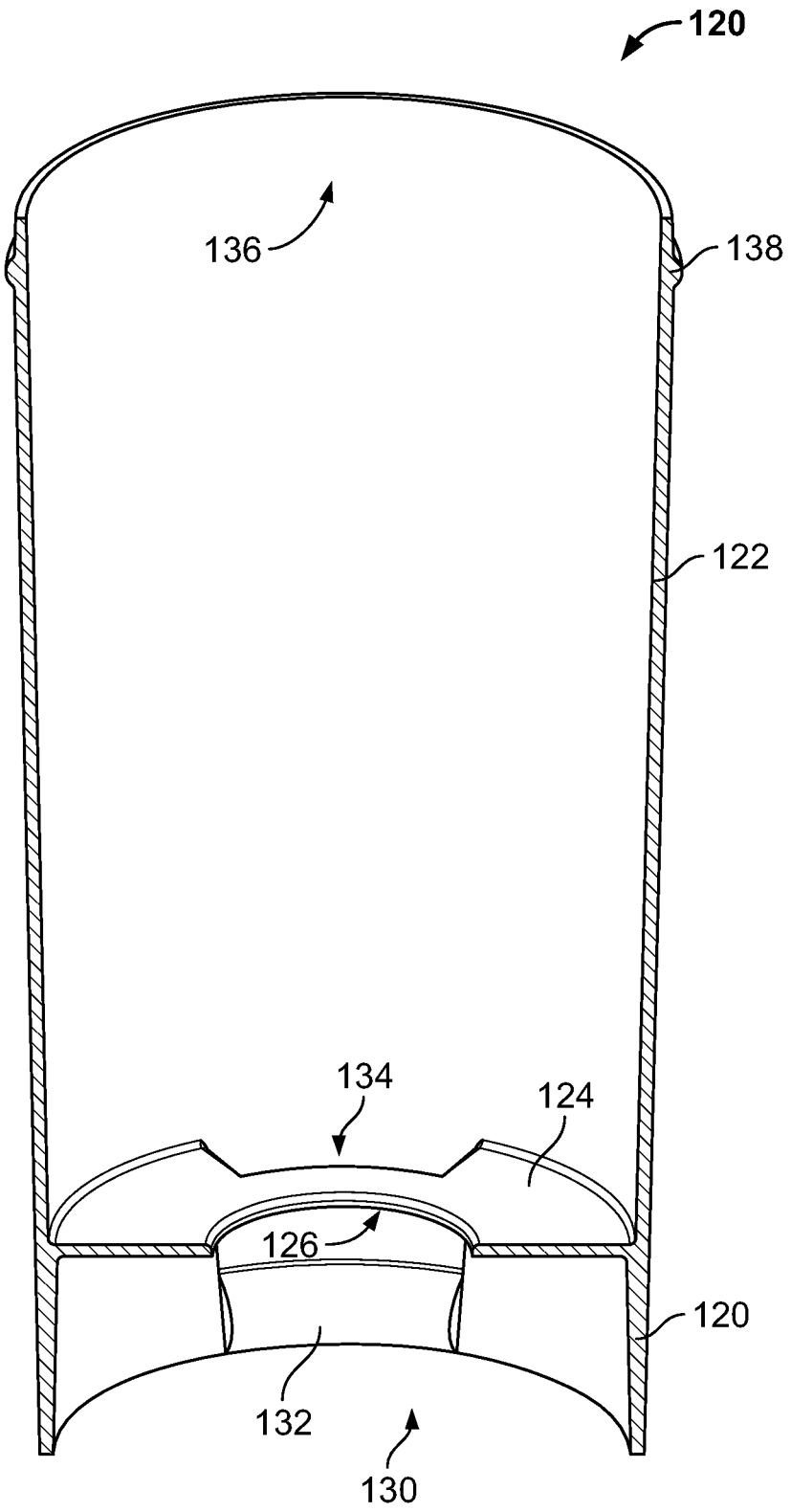
Figure 2P:
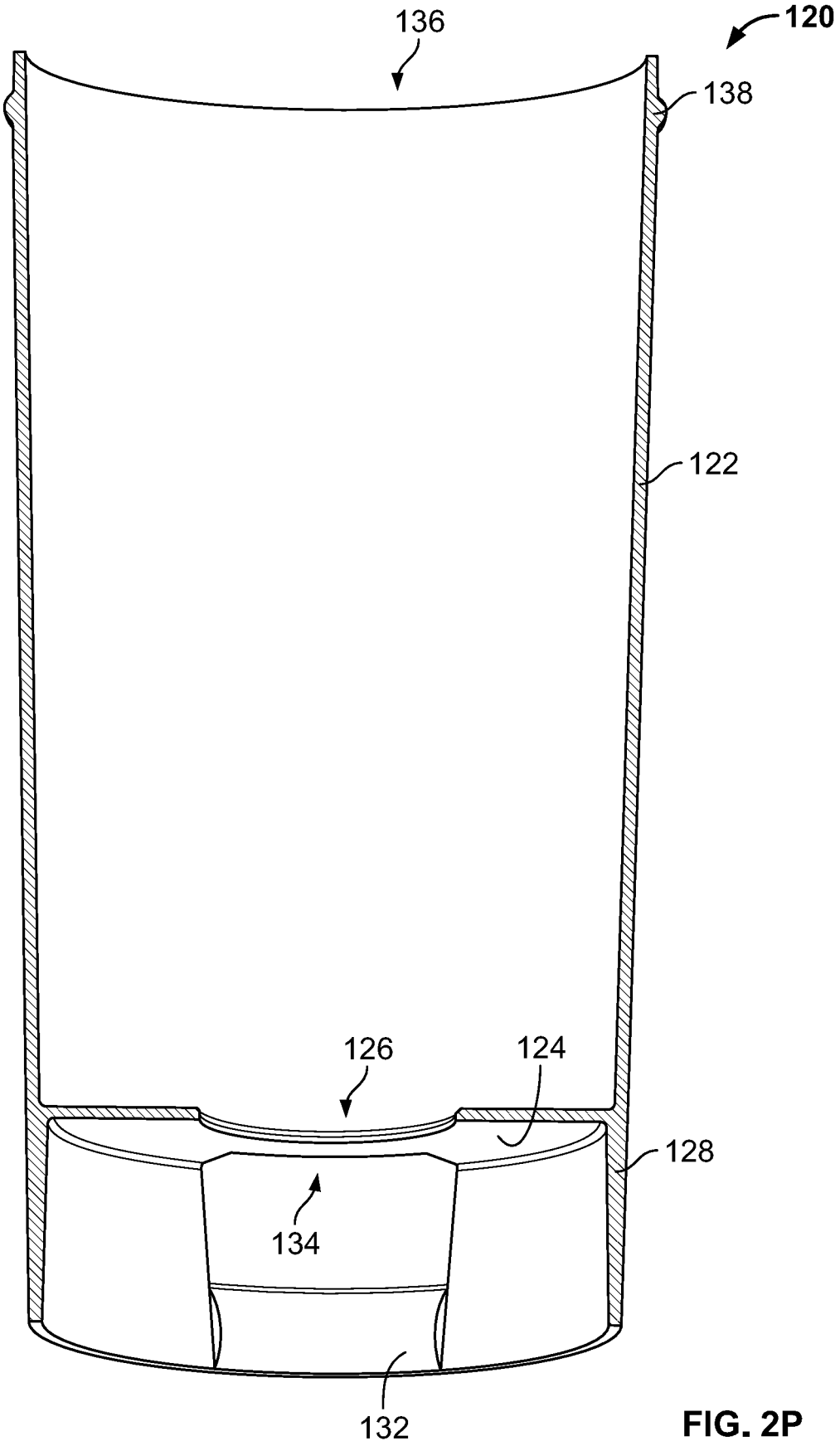
Figure 3A:
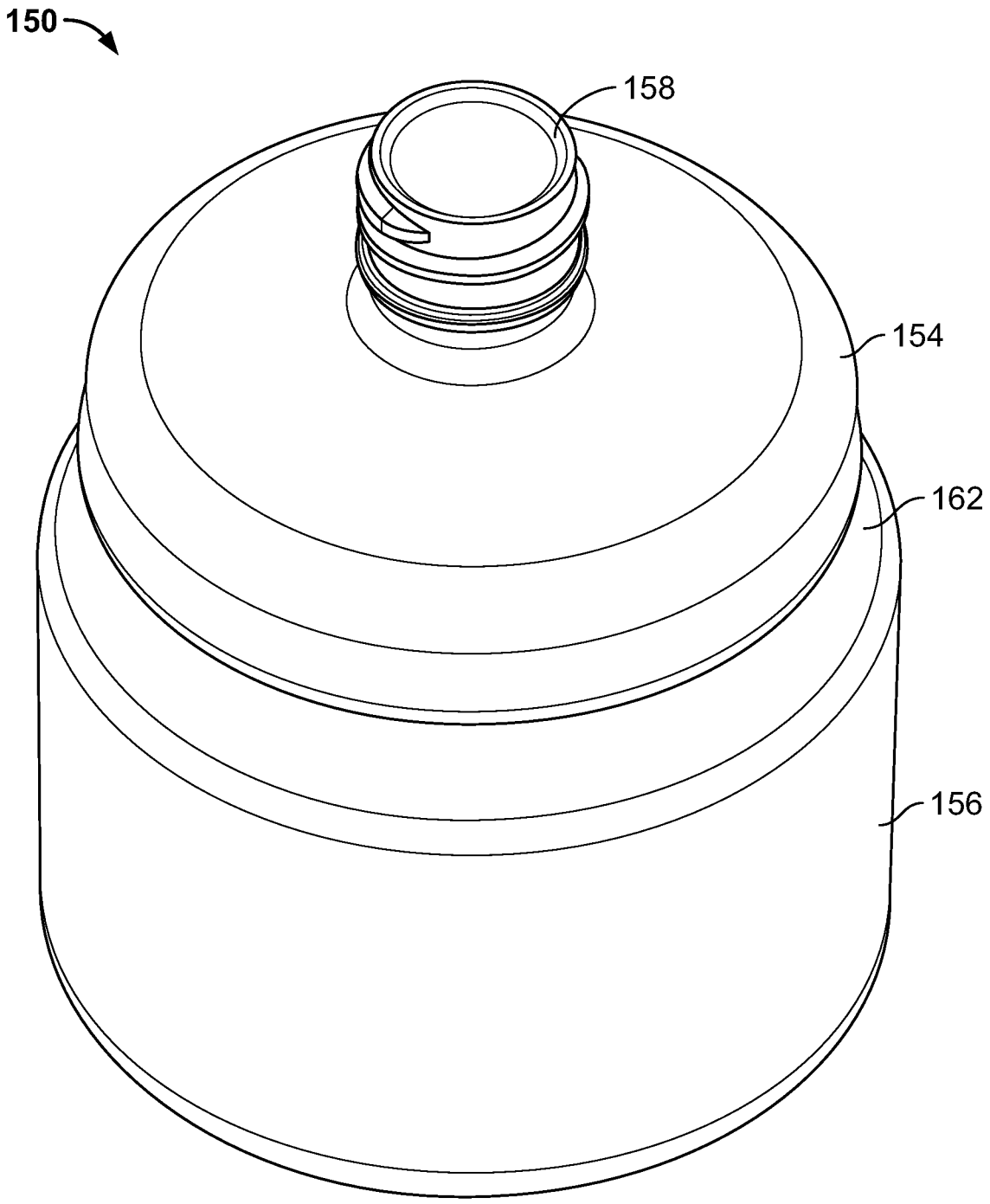
FIGS. 3A-3H are views of embodiments of the bottle of the modular dispenser system of the instant disclosure.
Figure 3B:
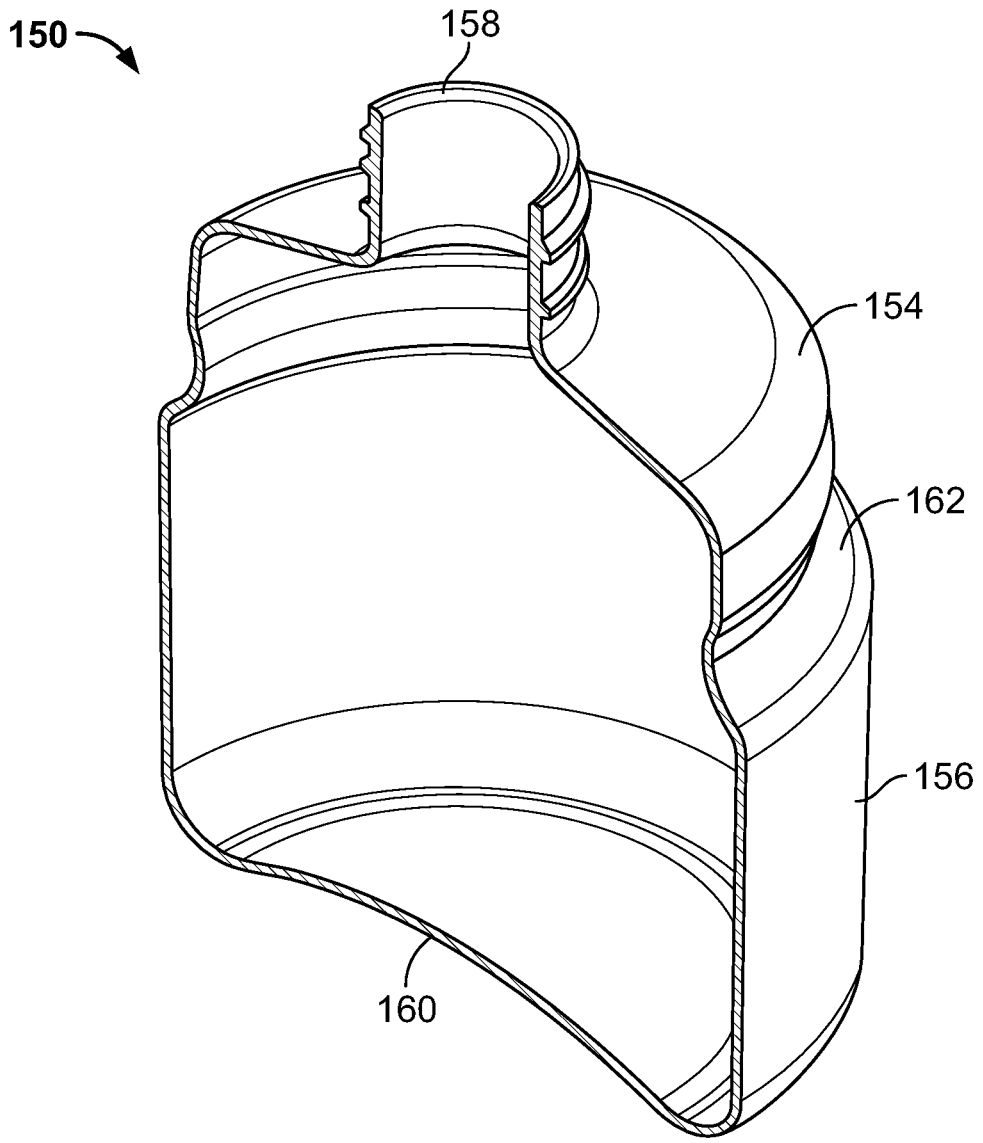
Figure 3C:
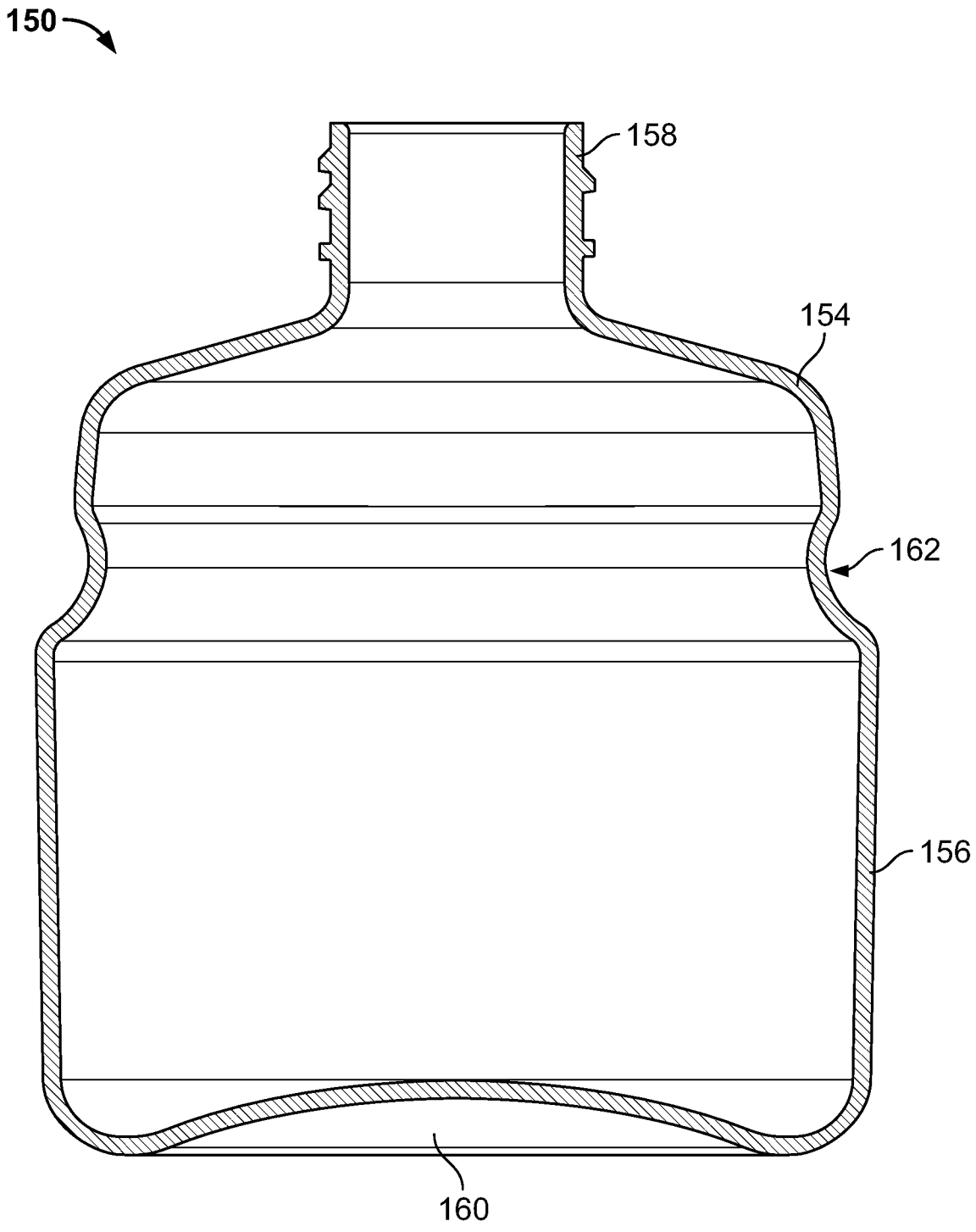
Figure 3D:
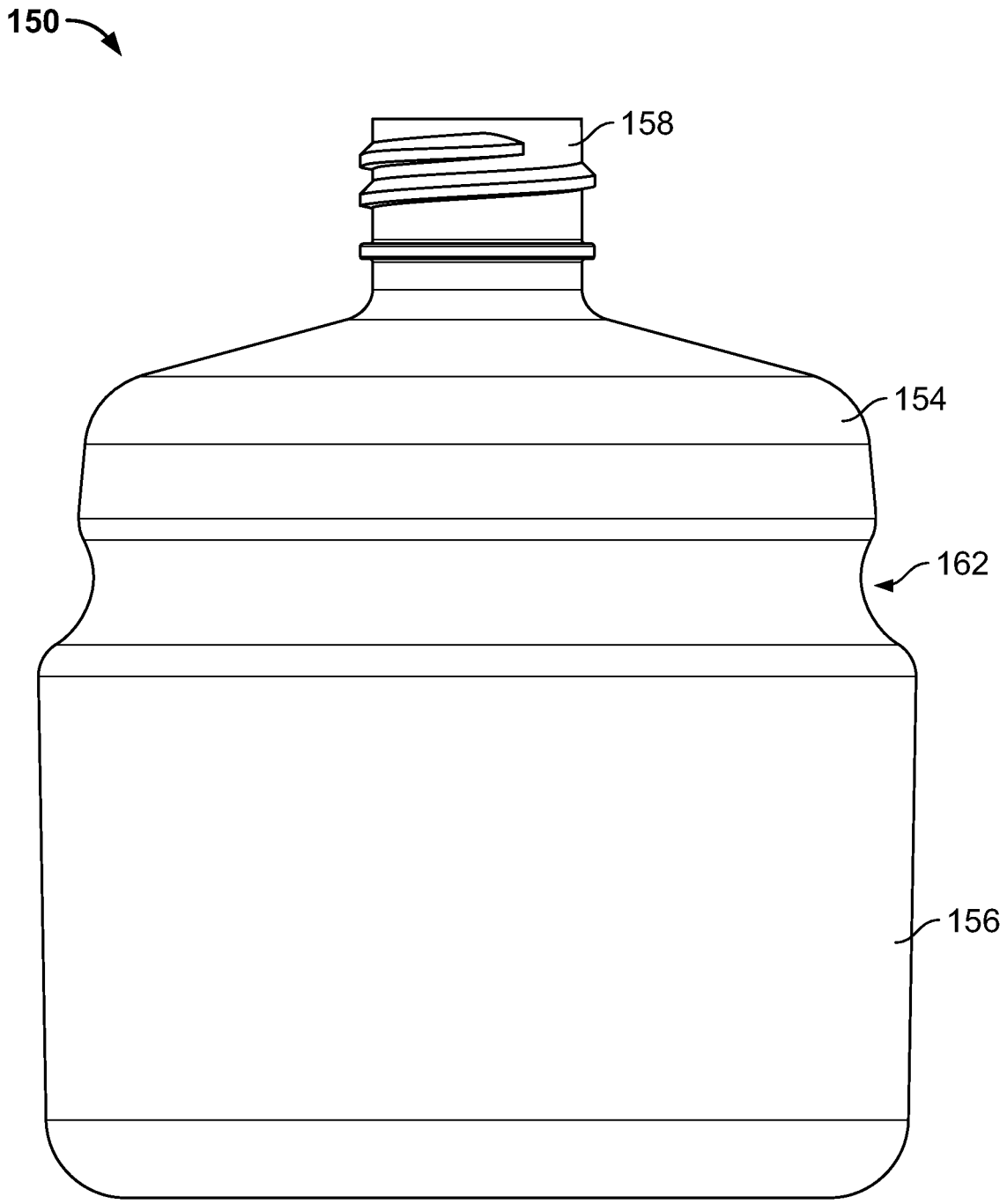
Figure 3E:
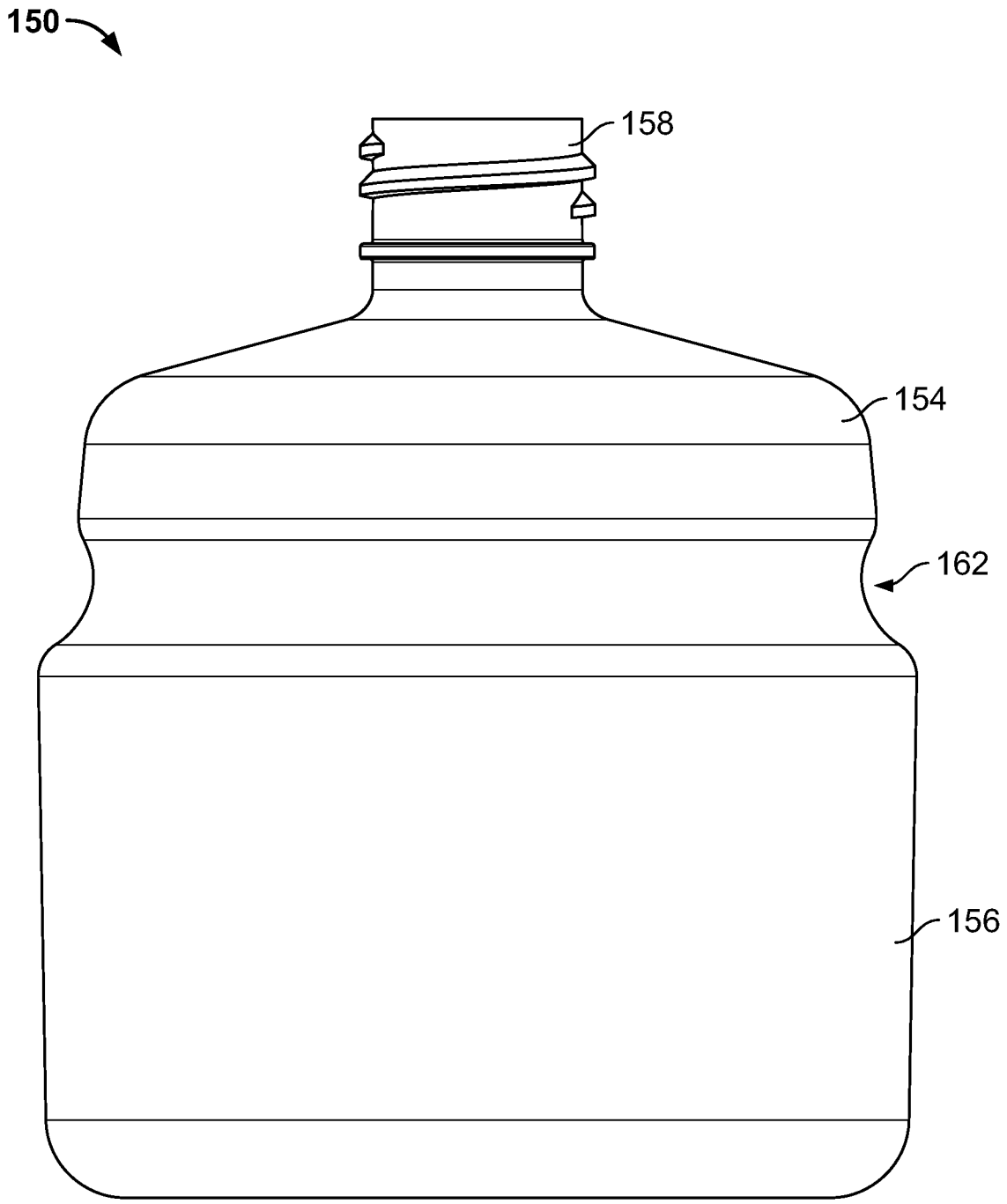
Figure 3F:
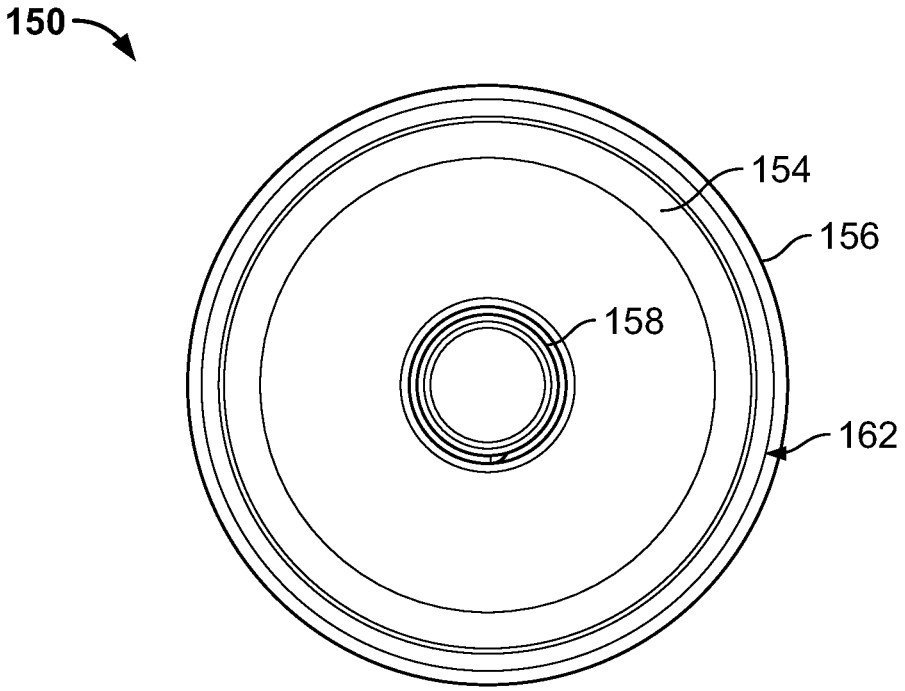
Figure 3G:
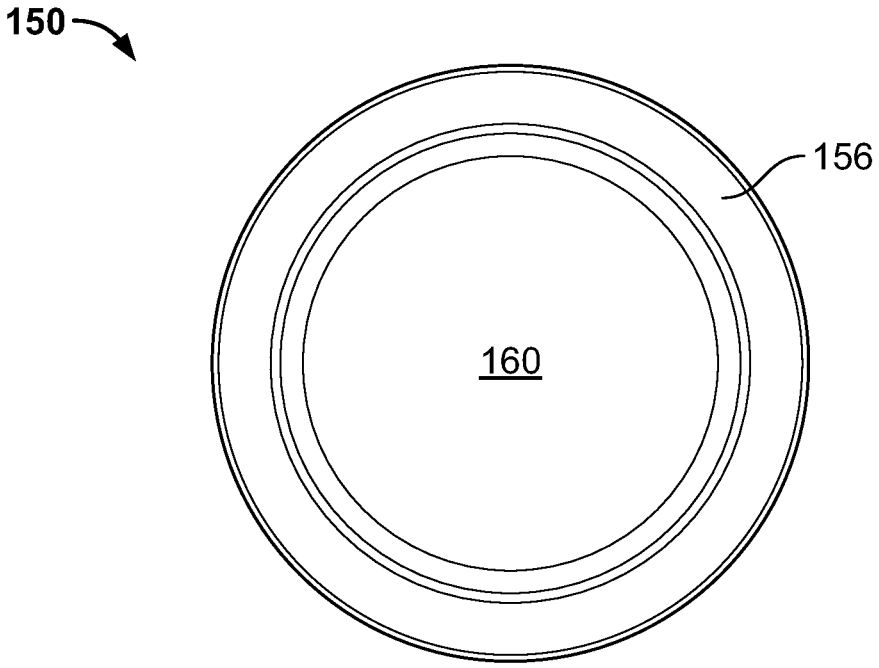
Figure 3H:
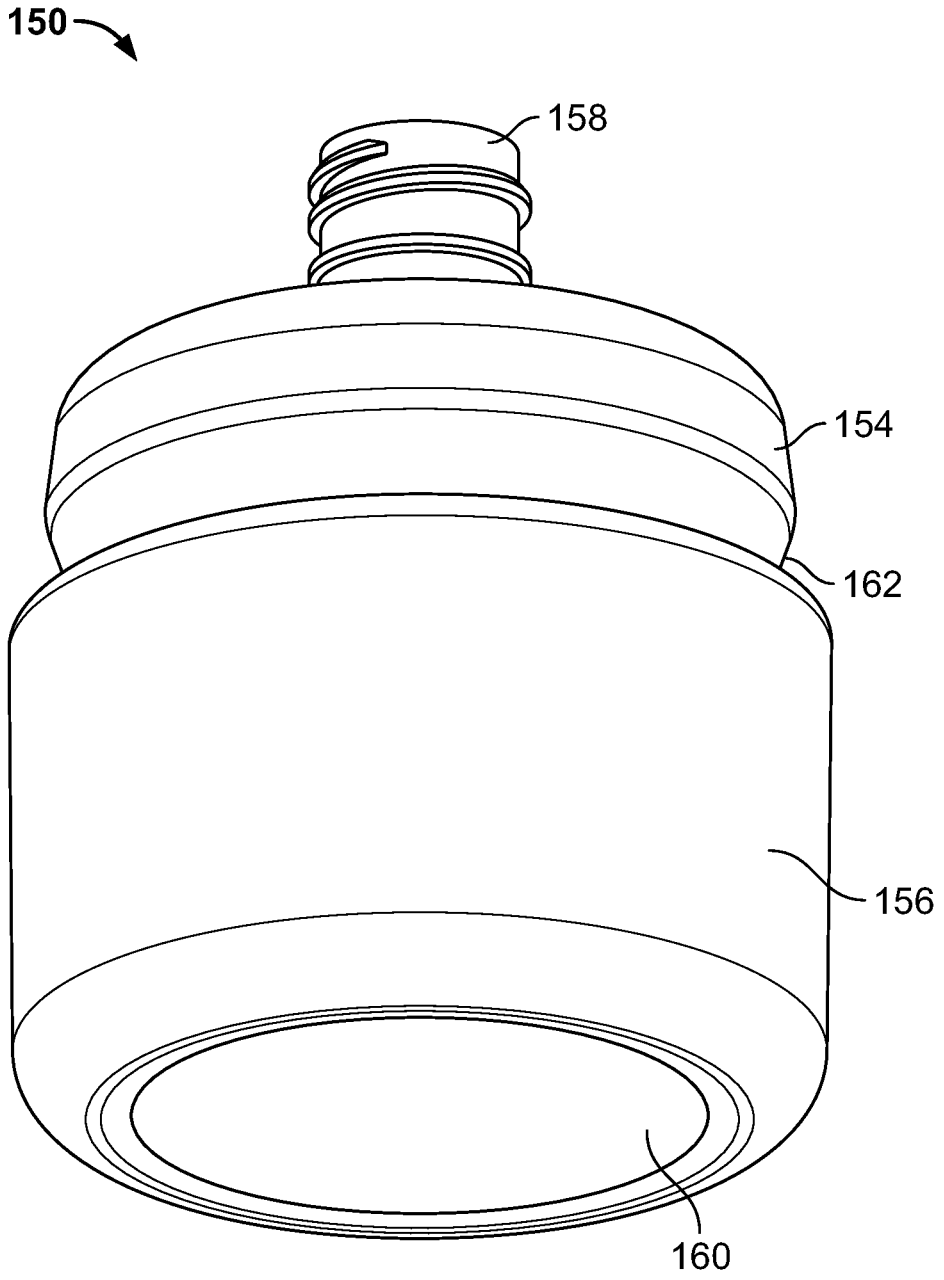
Figure 4A:
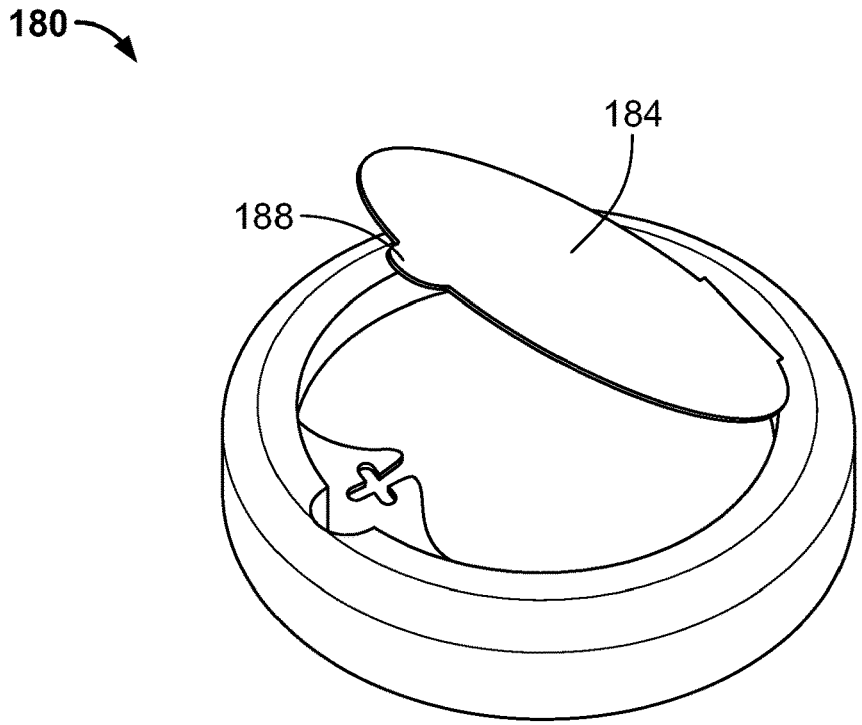
FIGS. 4A-4E are views of embodiments of the cover of the modular dispenser system of the instant disclosure.
Figure 4B:
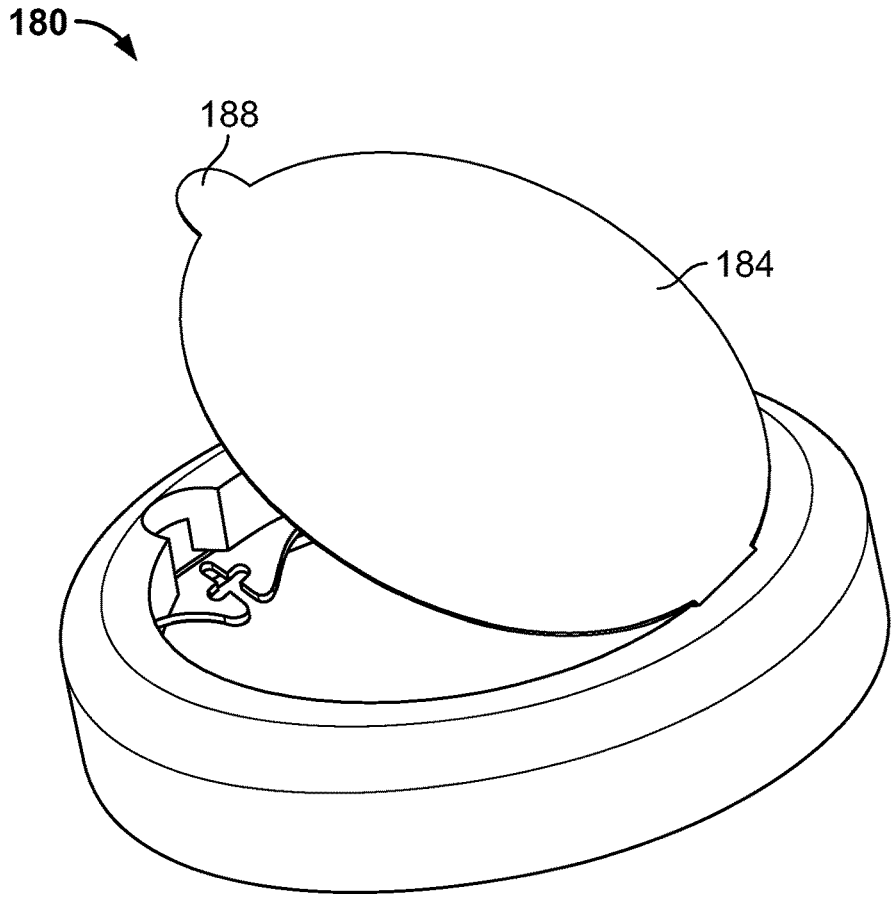
Figure 4C:
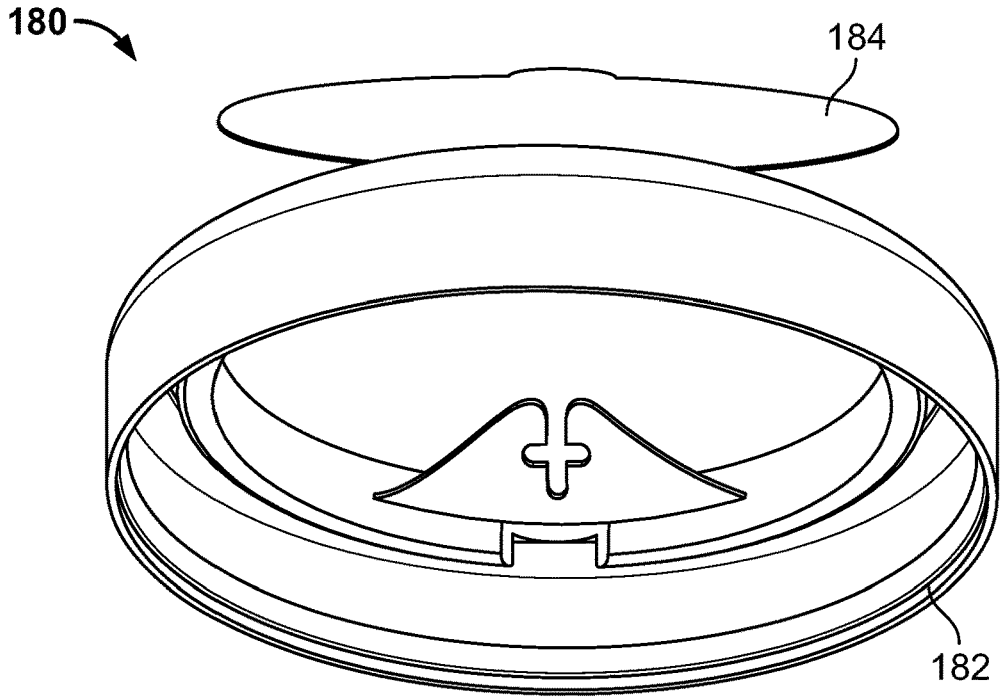
Figure 4D:
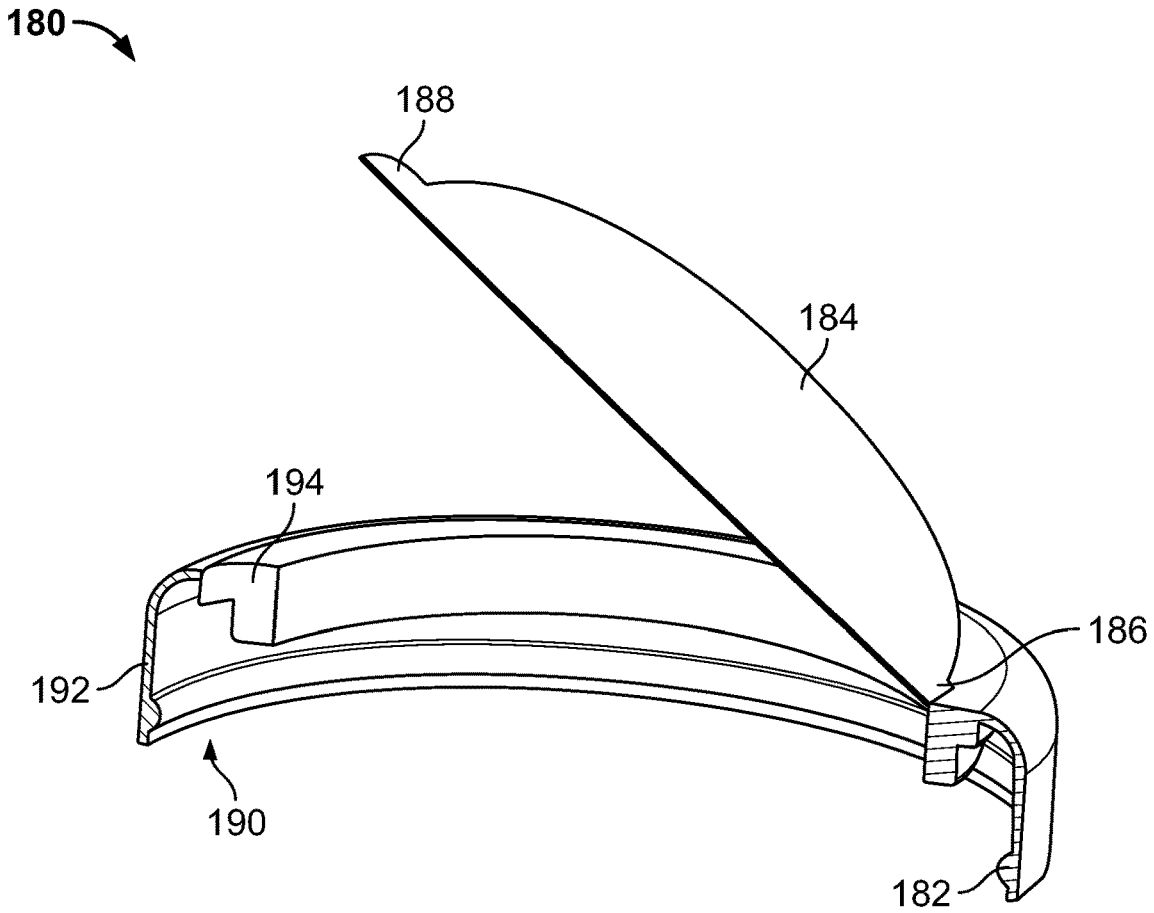
Figure 4E:
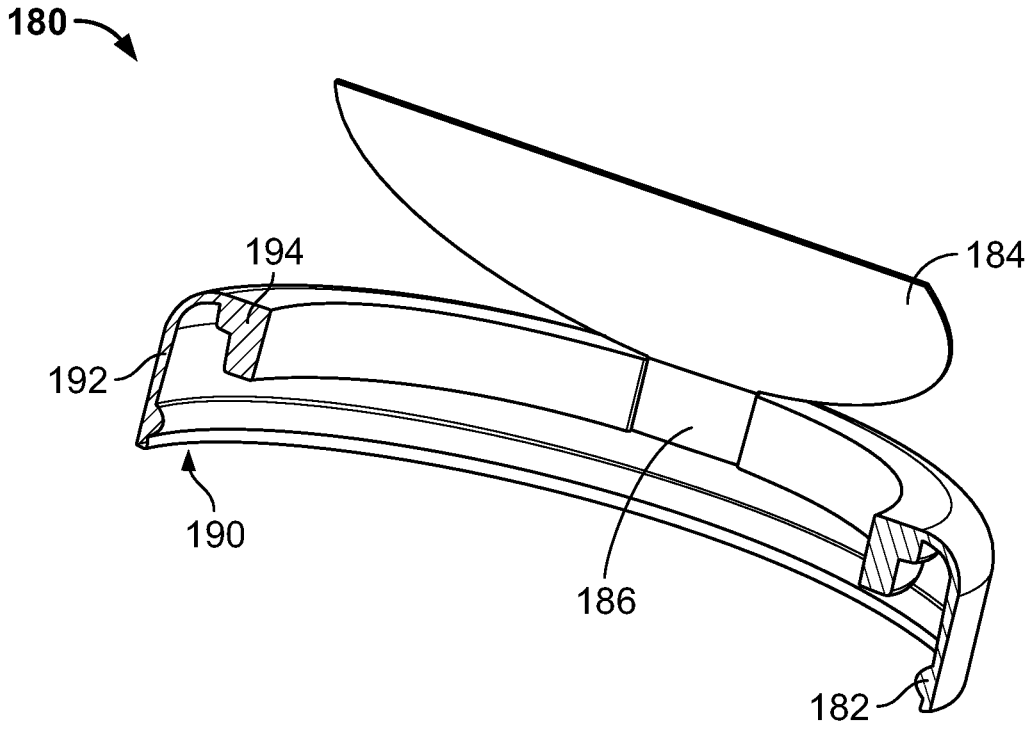

FIGS. 1A-1R show assembled, exploded, and cross-sectional views of embodiments of a modular dispenser system 100 including a body 120, a bottle 150, and a cover 180. FIGS. 2A-2P show views of embodiments of the body 120 of the modular dispenser system 100. FIGS. 3A-3H show views of embodiments of the bottle 150 of the modular dispenser system 100. FIGS. 4A-4E show views of embodiments of the cover 180 of the modular dispenser system 100.

The body 120 may be removably secured with the bottle 150, and in particular, the bottle 150 may be secured to the bottom or a bottom portion of the body 120. The cover 180 may be removably attached to the top of the body 120. When the body 120, the bottle 150, and the cover 180 are assembled together, the modular dispenser system 100 may be a unitary object that can be easily and conveniently carried, transported, and stored. How the body 120, the bottle 150, and the cover 180 may be secured together is described in more detail below. The body 120 and the bottle 150 can respectively contain a variety of items and liquids. For example, the body 120 can contain dry wipes for cleaning purposes, and the bottle 150 can contain a liquid formulation. The body 120 may contain other items, such as microfiber towels or other relatively sizeable items to the extent of the internal volume of body 120 above platform 124. In various embodiments, the cover 180 may open to allow access to the items within the body 120, and may be closed to protect the items from dust and dirt. Cover 180 may be affixed to body 120 via any number of means, including via screw threads, male/female engagement of a ring or protrusion with a mating groove to form a snap-fit, and a simple smooth wall interference fit.

At least some of the components of the modular dispenser system 100 may be formed of a polymer resin, such as polypropylene, high density polyethylene (HDPE), low density polyethylene (LDPE), polyethylene terephthalate (PET), or any combination thereof. In some embodiments, each of the components of the modular dispenser system 100 may be made from the same materials. In other embodiments, one or more components of the modular dispenser system 100 may be made from a different material than other components and thus may have different properties than the other components.

The components of the modular dispenser system 100 may be formed using any number or combination of methods, such as by a machining process, a casting process, an extrusion process, an injection molded process, and/or a blow-molded process, to name a few. For example, body 120 may be manufactured by an injection molded process, for example, using a simple clamshell mold. Bottle 150 may be manufactured using a blow-molded process, for example. In some embodiments, certain components may have characteristics that are different from the other components formed of resin. Various components of the modular dispenser system 100 may have different physical characteristics. For example, the components could be different colors for aesthetic reasons.

Figure 5A:
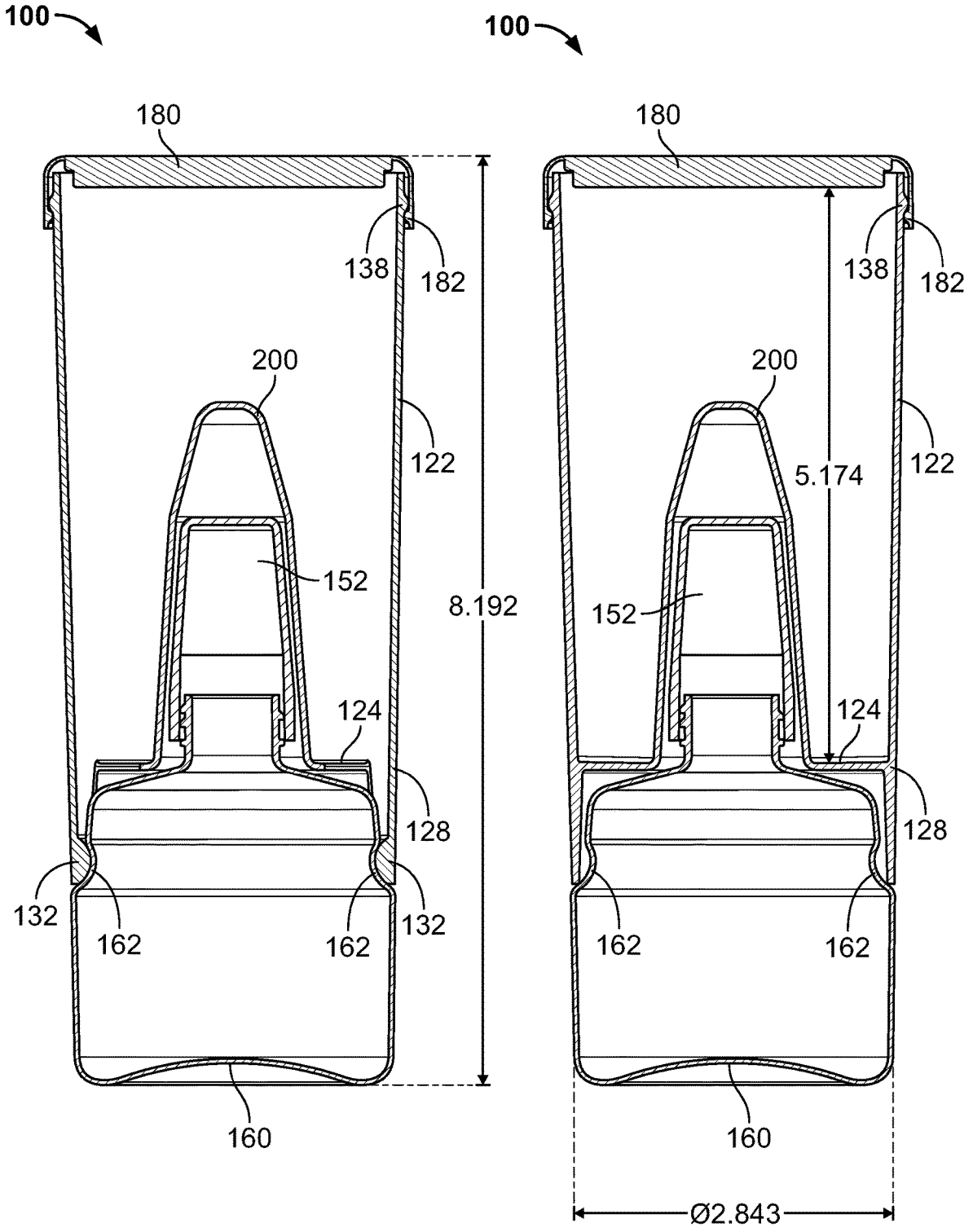
FIGS. 5A-5C are views of alternate embodiments of a modular dispenser system of the instant disclosure including a body, a bottle, and a cover.
Figure 5B:
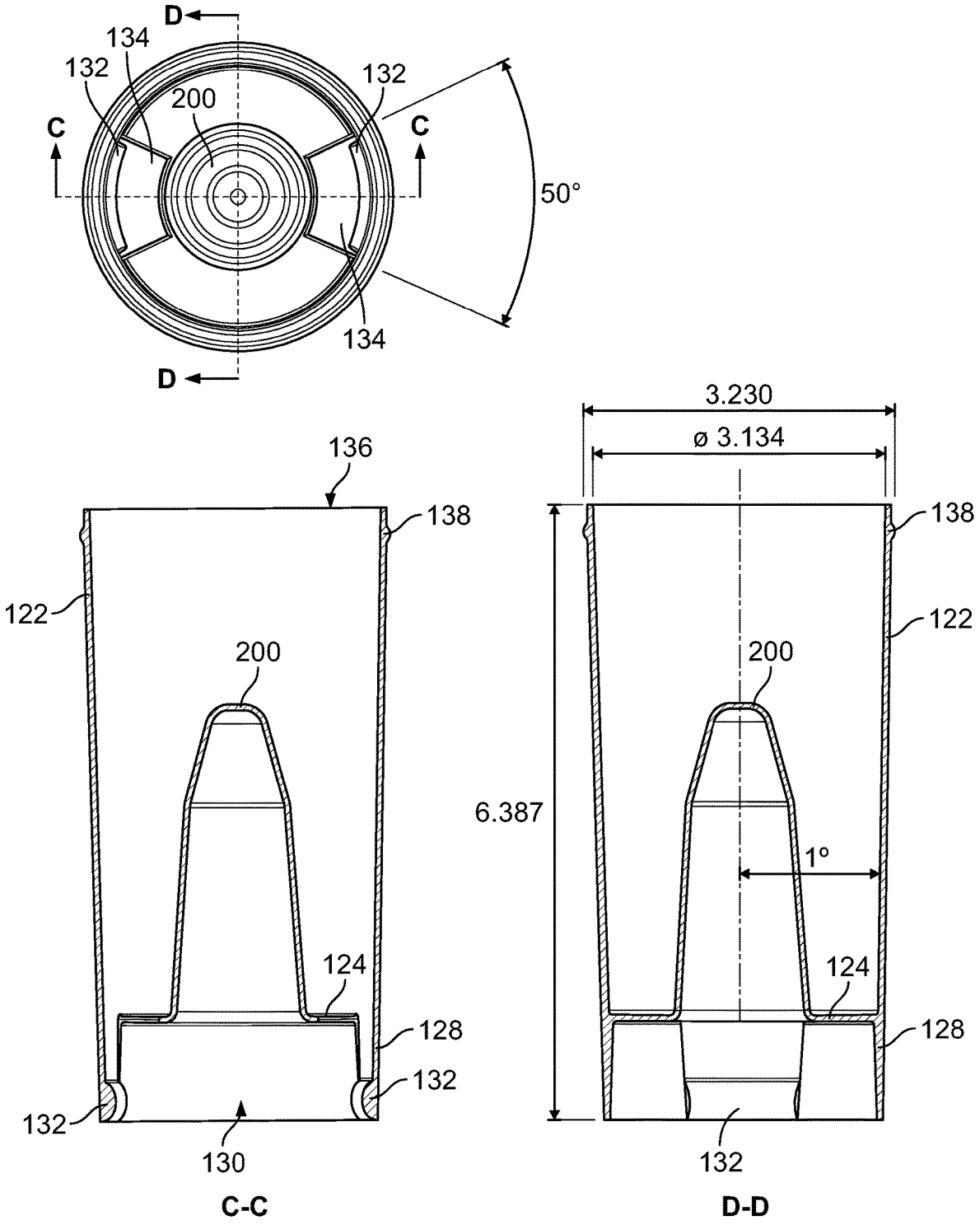

As described previously, the bottle 150 may be removably secured to the bottom or a bottom portion of the body 120. The body 120 may be generally cylindrical but may be any other suitable shape. The body 120 may have a generally tubular sidewall 122. In some embodiments, the sidewall 122 may gradually taper in the form of a mild cone so that the bottom of the body 120 is narrower than the top of the body 120. The tapering of the body 120 in this way to form a slightly conical structure may assist with the manufacturing process, e.g., allowing for the easier removal of a molded component. As shown in FIG. 5B, the sidewall 122 of body 120 may taper at approximately a 1 degree angle relative to the longitudinal centerline of the body 120. In other embodiments, the angle of the taper may be larger or smaller than approximately 1 degree. In some embodiments, the body 120 may be configured as a cylinder without any tapering sidewalls. A generally circular opening 136 may be formed by the sidewall 122 at the top of the body 120. The cover 180 may fit over the opening 136 of the body 120.

The body 120 may also include a generally planar platform 124 comprising one or more walls that canter-leverly extend laterally and/or inwardly from an inner surface of the sidewall 122. The platform 124, by itself or in conjunction with a spindle and/or a sprayer, can support and/or guide items within the body 120. The sidewall 122 may extend upwardly from the platform 124. The platform 124 may include one or more walls defining a hole 126 that is formed generally in the center of the platform 124. The hole 126 in the platform 124 may be adapted to accept at least a part of a sprayer 152 of the bottle 150, as described in more detail below. In some embodiments, the hole is coaxial with the body 120. In some embodiments like the embodiments shown in the figures, the platform 124 extends inwardly from the inner surface of the sidewall 122 at an approximately 90 degree angle relative to the longitudinal axis of revolution of the body 120.

The body 120 may further include a generally tubular skirt 128 that extends downwardly from the platform 124 and the sidewall 122. The skirt 128 may define a recessed area 130 that can fit over and cover a top portion 154 of the bottle 150. In some embodiments, the skirt 128 and the recessed area 130 may be generally cylindrical and tapered. In other embodiments, the skirt 128 and the recessed area 130 may be another suitable shape.

The body 120 may be removably secured to the bottle 150. In various embodiments, the body 120 may include one or more mating protrusions 132 disposed within the recessed area 130 on an inner surface of the skirt 128. The one or more mating protrusions 132 may be disposed circumferentially on part or all of the inner surface of the skirt 128. While the embodiments of the figures show two mating protrusions 132, any number of mating protrusions 132 are possible and contemplated. The mating protrusions 132 may be positioned at a bottom edge of the skirt 128 of body 120, or may be positioned elsewhere along skirt 128. The mating protrusions 132 of the body 120 may be adapted to engage with a corresponding groove 162 on the bottle 150 to enable removable attachment of the body 120 and the bottle 150 together.

The platform 124 may also include one or more openings 134 formed about the hole 126. In various embodiments, the openings 134 may be a generally arcuate shape and be generally aligned with the mating protrusions 132. The openings 134 may be any other suitable shape. The openings 134 may assist in manufacture of the body 120, such as when an injection molding process is utilized with molds forming the mating protrusions 132. In particular, the openings 134 may enable a mold to access the recessed area 130 so that the mating protrusions 132 can be formed.

The bottle 150 may include a detachable sprayer 152, a top portion 154, and a bottom portion 156. The sprayer 152 may be removably attachable to a mouth 158 on the top portion 154. For example, the sprayer 152 may be screwed onto threads of the mouth 158, or may be attached to the mouth 158 using another suitable attachment mechanism. In some embodiments, the sprayer 152 may be a pump spray, as is known in the art. The sprayer 152 may include a dip tube 153 for drawing the liquid formulation out of the bottle 150 and then out through a nozzle of the sprayer 152, such as when the pump spray is actuated by a user. The dip tube 153 may be connected to an internal port and a nozzle in the sprayer 152 for dispensing a liquid or a foam therefrom. In various embodiments, the sprayer 152 may include a cap for protecting the sprayer 152 from dust and dirt, and from being accidentally actuated. For purposes of this disclosure, sprayer 152 and dip tube 153 are shown in the drawings to depict their general position relative to other components of modular dispenser system 100.

In various embodiments, the top portion 154 of the bottle 150 may be generally cylindrical and have a particular diameter at its widest part. The top portion 154 may gradually narrow from its widest part to the mouth 158. In other embodiments, the top portion 154 may be another suitable shape and/or size. In various embodiments, the bottom portion 156 may be generally cylindrical and have a particular diameter at its widest part. The diameter of the bottom portion 156 may generally be greater than the diameter of the top portion 154. In other embodiments, the bottom portion 156 may be another suitable shape and/or size. The bottom portion 156 may include a concave punt 160 at its bottom. The top portion 154 and/or the bottom portion 156 of the bottle 150 may include one or more textures to enhance a user's grip of the bottle 150. The one or more textures may include a plurality of different textures, for example, a texture on the top portion 154 and a different texture on the bottom portion 156. In other embodiments, only top portion 154 includes a texture. In yet other embodiments, only bottom portion 156 includes a texture. The one or more textures may include a plurality of randomly and/or uniformally-spaced, small protrusions extending from the outer surface of the bottle 150. In other embodiments, the one or more textures may include a plurality of randomly and/or uniformally-spaced, small cuts, slots, groove that extend inwardly from the outer surface of the bottle 150.

The groove 162 may be disposed between and connect the top portion 154 and the bottom portion 156 of the bottle 150. The groove 162 may be circumferentially formed on part or all of the bottle 150. As described above, the groove 162 may be adapted to engage with the mating protrusions 132 of the body 120. In this way, the body 120 and the bottle 150 may be removably secured to one another.

All or part of the sprayer 152 may fit into the hole 126 formed in the platform 124, when the body 120 and the bottle 150 are secured to one another. In various embodiments, the sprayer 152 may be adapted to be used as a spindle about which a roll of towels, towelettes, or wipes may be positioned. For example, a roll of dry wipes may be wrapped around a core or have a center opening. When the roll of wipes is placed within the body 120, the core or center opening can accept the spindle (i.e., the sprayer 152). In this way, the position of the roll of wipes can be substantially maintained within the body 120 while being able to freely spin about the spindle when wipes are dispensed or removed from the roll.

Figure 5C:
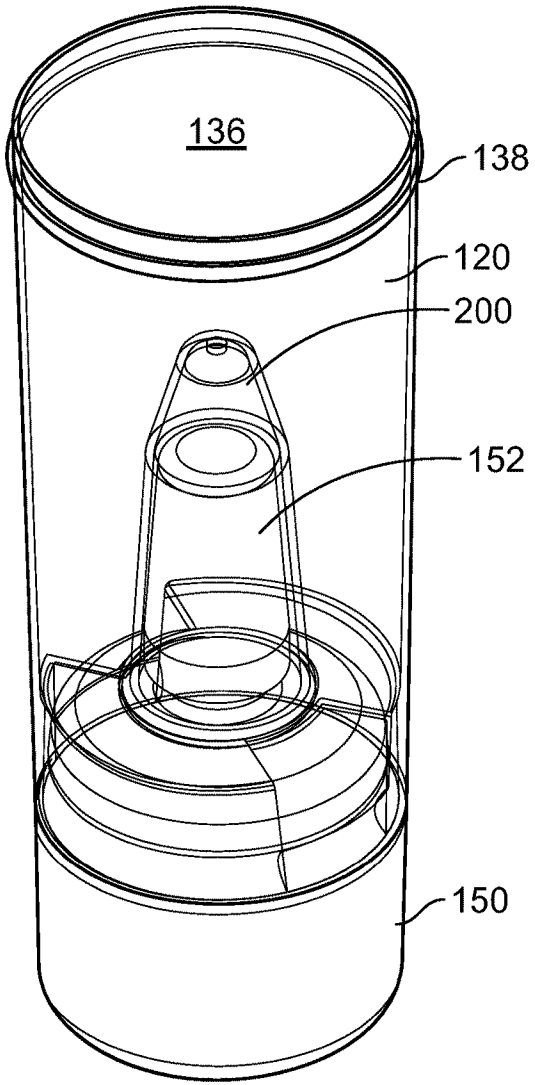
Figure 5C:
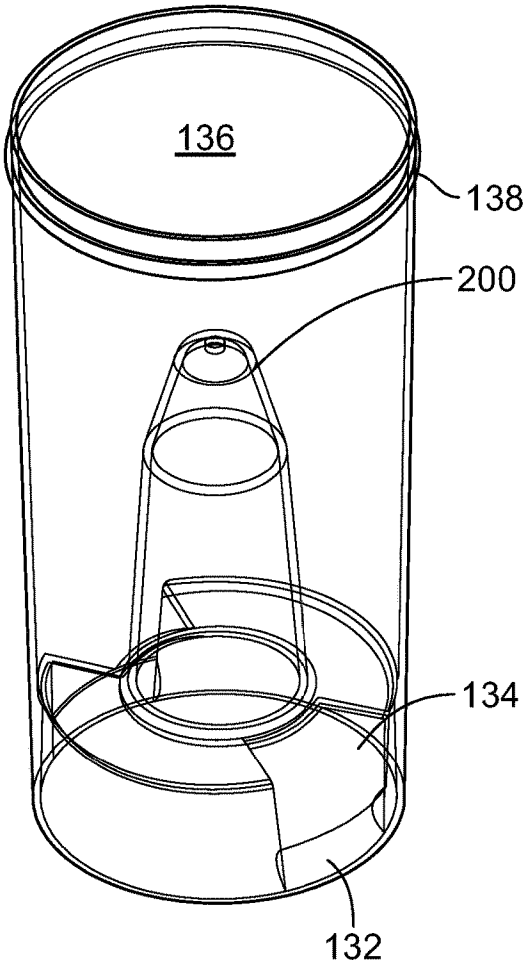

In some embodiments, the body 120 may not have a hole 126 to accept the sprayer 152. Instead, as best shown in FIGS. 5A-5C, the body 120 may include a spindle 200 that is disposed atop the platform 124. The spindle 200 may have a tapered conical shape, or any other suitable shape. The sprayer 152 of the bottle 150 may fit into the spindle 200 when the bottle 150 and the body 120 are secured together. The sprayer 152 therefore does not act as a spindle in these embodiments, since the spindle 200 exists. As in the example above, a roll of wipes may be placed within the body 120 and its core or center opening can accept the spindle 200.

The cover 180 may be removably engaged with the body 120 at the opening 136. The cover 180 may have a recessed area 190 formed by two sidewalls 192, 194 of the cover 180. The recessed area 190 may fit over the rim of the opening 136 of the body 120. In various embodiments, the body 120 may include a protrusion 138 disposed on an outer surface of the sidewall 122 at a location below the opening 136. The protrusion 138 may be disposed circumferentially all or part of the way around the outer surface of the sidewall 122. The cover 180 may include a protrusion 182 disposed on an inner surface of the cover 180. The protrusion 182 may be disposed circumferentially all or part of the way around the inner surface of the cover 180. The protrusion 182 of the cover 180 may be adapted to engage with the protrusion 138 of the body 120 such that the cover 180 is secured to the body 120 when the recessed area 190 is fitted over the opening 136. In other embodiments, the cover 180 may be screwed onto threads on the body 120, or by any other suitable attachment mechanism.

The cover 180 may include an openable lid 184 that is attached to the cover 180 via a flexible hinge 186, as is known in the art. Under the lid 184, the cover 180 may include a feature for dispensing an item and having an aperture that restricts the passage of the item to allow a user to separate, for example, one item from the next. The lid 184 may be opened by lifting it via a tab 188, for example. While the figures show an openable lid 184 having a flexible hinge 186, other types of lids are possible and contemplated. In addition, the cover 180 may be a canister cover that snaps onto or over the rim of the opening 136 of the body 120, or may be another suitable type of cover.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A modular dispenser system, comprising:

(a) a generally cylindrical body comprising:

a platform including one or more walls defining aa hole therein and one or more openings positioned about the hole and generally aligned with one or more mating protrusions of the body positioned below the platform;

a sidewall extending upwardly from the platform;

a skirt extending downwardly from the platform and forming a recessed area, the skirt adapted to fit over a top portion of a bottle; and a generally circular opening formed at the top of the sidewall; and (b) the bottle removably securable to the body, the bottle comprising:

a generally cylindrical top portion having a first diameter, the top portion comprising a mouth;

a generally cylindrical bottom portion extending from the top portion and having a second diameter greater than the first diameter; and a sprayer removably attachable to the mouth of the top portion, wherein at least a part of the sprayer is adapted to be accepted by the hole of the platform of the body, wherein the one or more mating protrusions of the body are disposed circumferentially on an inner surface of the skirt within the recessed area, and wherein the bottle further comprises a circumferential groove connecting the top portion and the bottom portion, wherein the groove is adapted to engage with the one or more mating protrusions of the body.

2. The modular dispenser system of claim 1, further comprising a cover removably engageable with the generally circular opening formed at the top of the sidewall of the body.

3. The modular dispenser system of claim 2, wherein:

the body comprises a first protrusion disposed circumferentially on an outer surface of the sidewall about the opening; and the cover comprises a second protrusion disposed circumferentially on an inner surface of the cover and adapted to be removably engageable with the first protrusion of the body.

4. The modular dispenser system of claim 2, wherein the cover comprises an openable lid having a flexible living hinge attached to the cover.

5. The modular dispenser system of claim 2, wherein the cover further comprises a dispensing feature having an aperture to hold an item.

6. The modular dispenser system of claim 1, wherein the sprayer is adapted to be used as a spindle when the body and the bottle are secured together.

7. The modular dispenser system of claim 1, wherein the bottle further comprises a spray cap that covers the sprayer.

8. The modular dispenser system of claim 1, further comprising:

a roll of dry wipes contained within the body and fitted over the sprayer; and a liquid formulation contained within the bottle.

9. The modular dispenser system of claim 8, wherein:

the sprayer is adapted to be used as a spindle when the body and the bottle are secured together; and the spindle maintains a position of the roll of dry wipes within the body.

10. A modular dispenser system, comprising:

(a) a generally cylindrical body comprising:

a platform comprising:

a hole formed therein; and one or more openings formed about the hole that are generally aligned with one or more mating protrusions;

a sidewall extending upwardly from the platform;

a skirt extending downwardly from the platform and forming a recessed area, the skirt adapted to fit over a top portion of a bottle;

a generally circular opening formed at the top of the sidewall; and the one or more mating protrusions disposed circumferentially on an inner surface of the skirt within the recessed area;

(b) the bottle removably securable to the body, the bottle comprising:

a generally cylindrical top portion having a first diameter, the top portion comprising a mouth;

a generally cylindrical bottom portion extending from the top portion and having a second diameter greater than the first diameter;

a circumferential groove connecting the top portion and the bottom portion, wherein the groove is adapted to engage with the one or more mating protrusions of the body; and a sprayer removably attachable to the mouth of the top portion, wherein at least a part of the sprayer is adapted to be accepted by the hole of the platform of the body, and wherein the sprayer is further adapted to be used as a spindle when the body and the bottle are secured together;

(c) a cover removably engageable with the opening of the body, the cover comprising:

an openable lid having a flexible living hinge attached to the cover; and a dispensing feature having an aperture to hold a dry wipe;

(d) a roll of dry wipes contained within the body and fitted over the sprayer; and (e) a liquid formulation contained within the bottle.

11. A modular dispenser system, comprising:

(a) a generally cylindrical body comprising a first end and a second end, the body further comprising a platform canter-leverly extending radially inwardly from an inner surface of the body, the platform including one or more walls defining a hole therein that is coaxial with the cylindrical body, the platform positioned longitudinally along the body between the first end and the second end;

a sidewall extending upwardly from the platform toward the first end, the sidewall including a circumferential nub positioned proximate the first end and extending outwardly from an outer surface of the body to receive and removably capture a dispenser closure;

a skirt extending downwardly from the platform toward the second end and forming a recessed area;

one or more openings positioned in the platform about the hole that are generally aligned with a pair of opposed, partial-circumferential protrusions positioned at the second end and extending radially inwardly from an inner surface of the skirt; and a generally circular opening formed at the first end and at the second end; and (b) a bottle removably securable to the body, the bottle comprising a generally cylindrical top portion having a first diameter and a circumferential groove for engaging with the opposed, partial-circumferential protrusions for removably securing the bottle to the body, the top portion comprising a mouth;

a generally cylindrical bottom portion extending from the top portion and having a second diameter greater than the first diameter; and a sprayer removably attachable to the mouth of the top portion, wherein at least a part of the sprayer is adapted to be accepted by the hole of the platform of the body.

12. A modular dispenser system, comprising:

(a) a generally cylindrical body comprising:

a platform including one or more walls defining a hole therein and one or more openings formed about the hole;

a sidewall extending upwardly from the platform;

a skirt extending downwardly from the platform and forming a recessed area, the skirt adapted to fit over a top portion of a bottle;

a generally circular opening formed at the top of the sidewall; and one or more mating protrusions disposed circumferentially on an inner surface of the skirt within the recessed area, wherein the one or more openings are generally aligned with the one or more mating protrusions; and (b) the bottle removably securable to the body, the bottle comprising:

a generally cylindrical top portion having a first diameter, the top portion comprising a mouth;

a generally cylindrical bottom portion extending from the top portion and having a second diameter greater than the first diameter;

a sprayer removably attachable to the mouth of the top portion, wherein at least a part of the sprayer is adapted to be accepted by the hole of the platform of the body; and a circumferential groove connecting the top portion and the bottom portion, wherein the groove is adapted to engage with the one or more mating protrusions of the body.

* * * * *